US011576440B2

(12) United States Patent
Cadieux et al.

(10) Patent No.: US 11,576,440 B2
(45) Date of Patent: Feb. 14, 2023

(54) METHOD AND SYSTEM FOR THE AUTOMATED PRODUCTION OF E-VAPOR DEVICES

(71) Applicant: Altria Client Services LLC, Richmond, VA (US)

(72) Inventors: Edmond J. Cadieux, Mechanicsville, VA (US); Martin Garthaffner, Chesterfield, VA (US); Travis Garthaffner, Midlothian, VA (US); Christopher R. Newcomb, Powhatan, VA (US); Barry S. Smith, Richmond, VA (US); Jeffrey A. Swepston, Powhatan, VA (US)

(73) Assignee: Altria Client Services LLC, Richmond, VA (US)

( * ) Notice: Subject to any disclaimer, the term of this patent is extended or adjusted under 35 U.S.C. 154(b) by 1189 days.

(21) Appl. No.: 14/686,431

(22) Filed: Apr. 14, 2015

(65) Prior Publication Data

US 2015/0289565 A1 Oct. 15, 2015

Related U.S. Application Data

(60) Provisional application No. 61/979,326, filed on Apr. 14, 2014.

(51) Int. Cl.
*A24F 40/80* (2020.01)
*A24F 40/70* (2020.01)
(Continued)

(52) U.S. Cl.
CPC ..... *A24F 40/80* (2020.01); *A24F 40/70* (2020.01); *A24C 5/327* (2013.01); *A24F 40/10* (2020.01)

(58) Field of Classification Search
None
See application file for complete search history.

(56) References Cited

U.S. PATENT DOCUMENTS 2,809,640 A 10/1957 Oldenkamp
3,506,017 A 4/1970 Schubert
(Continued)

FOREIGN PATENT DOCUMENTS

CN 1046664 A 11/1990
CN 1094372 A 11/1994
(Continued)

OTHER PUBLICATIONS

International Search Report dated Feb. 3, 2016, issued in corresponding International Application No. PCT/IB2015/001477.
(Continued)

*Primary Examiner* — Michael J Felton
*Assistant Examiner* — Katherine A Will
(74) *Attorney, Agent, or Firm* — Harness, Dickey & Pierce, P.L.C.

(57) ABSTRACT

A method for automated manufacturing of e-vapor devices may include establishing a procession of partially assembled, oriented cartridge units of the e-vapor devices in an assembly path. The method may additionally include preparing the cartridge units for filling while the cartridge units are moving on a first drum-to-drum transport path of the assembly path. The method may also include adding liquid to the cartridge units while the cartridge units are moving in a filling workstation of the assembly path. The method may also include preparing the cartridge units for sealing while the cartridge units are moving on a second drum-to-drum transport path of the assembly path. The
(Continued)

method further includes sealing the cartridge units while the cartridge units are moving in a sealing workstation of the assembly path.

21 Claims, 17 Drawing Sheets

(51) Int. Cl.
*A24F 40/10* (2020.01)
*A24C 5/32* (2006.01)

(56) References Cited

U.S. PATENT DOCUMENTS

| | | | | |
|---|---|---|---|---|
| 3,811,567 | A | 5/1974 | Tomita et al. | |
| 3,837,378 | A | 9/1974 | Kanki et al. | |
| 3,961,633 | A | 6/1976 | Schubert et al. | |
| 3,986,320 | A | 10/1976 | Bausch et al. | |
| 4,545,832 | A | 10/1985 | Hoffmann | |
| 4,980,969 | A | 1/1991 | Marchesini et al. | |
| 5,024,046 | A | 6/1991 | Spatafora et al. | |
| 5,024,242 | A | 6/1991 | Garthaffner et al. | |
| 5,116,298 | A * | 5/1992 | Bondanelli | A24C 5/34 131/906 |
| 5,390,469 | A | 2/1995 | Shimizu et al. | |
| 5,464,495 | A | 11/1995 | Eder | |
| 5,577,518 | A | 11/1996 | Draghetti et al. | |
| 5,702,559 | A | 12/1997 | Bright | |
| 5,772,001 | A | 6/1998 | Otruba et al. | |
| 6,450,230 | B1 | 9/2002 | Otruba | |
| 6,708,694 | B2 | 3/2004 | Dombek | |
| 7,296,578 | B2 | 11/2007 | Read, Jr. | |
| 8,828,170 | B2 | 9/2014 | Stamatiou et al. | |
| 9,828,130 | B2 | 11/2017 | Florian et al. | |
| 9,854,839 | B2 | 1/2018 | Tucker et al. | |
| 9,877,516 | B2 | 1/2018 | Tucker et al. | |
| 9,963,260 | B2 | 5/2018 | Cadieux et al. | |
| 9,968,131 | B2 | 5/2018 | Swepston et al. | |
| 10,988,368 | B2 | 4/2021 | Biel et al. | |
| 2002/0005207 | A1 | 1/2002 | Wrenn et al. | |
| 2004/0020500 | A1 | 2/2004 | Wrenn et al. | |
| 2005/0217207 | A1 | 10/2005 | Konishi et al. | |
| 2008/0017203 | A1 | 1/2008 | Fagg et al. | |
| 2012/0167906 | A1 | 7/2012 | Gysland | |
| 2013/0199550 | A1 | 8/2013 | Ono | |
| 2014/0041655 | A1 | 2/2014 | Barron et al. | |
| 2015/0272204 | A1 * | 10/2015 | Kraisuwannasarn | A24C 5/3412 382/141 |
| 2017/0006921 | A1 * | 1/2017 | Lemay | A24F 47/008 |

FOREIGN PATENT DOCUMENTS

| | | | |
|---|---|---|---|
| CN | 1203699 | A | 12/1998 |
| CN | 1268470 | A | 10/2000 |
| CN | 101310632 | A | 11/2008 |
| CN | 201758770 | U | 3/2011 |
| CN | 102177071 | A | 9/2011 |
| CN | 202603608 | U | 12/2012 |
| CN | 203015835 | U | 6/2013 |
| CN | 103369979 | A | 10/2013 |
| CN | 103491812 | A | 1/2014 |
| CN | 103584287 | A | 2/2014 |
| DE | 1532561 | A1 | 4/1970 |
| DE | 3117999 | A1 | 11/1982 |
| DE | 202006006452 | U1 | 7/2006 |
| EP | 0330495 | A2 | 8/1989 |
| EP | 0395280 | A2 | 10/1990 |
| EP | 0544089 | A2 | 6/1993 |
| EP | 0579026 | A1 | 1/1994 |
| JP | 2005247325 | A | 9/2005 |
| WO | WO-2013002657 | A1 | 1/2013 |
| WO | WO-2013076750 | A1 | 5/2013 |
| WO | WO-2015/123558 | A2 | 8/2015 |
| WO | WO-2015160809 | A1 | 10/2015 |

OTHER PUBLICATIONS

Written Opinion of the International Searching Authority dated Feb. 3, 2016, issued in corresponding International Application No. PCT/IB2015/001477.
International Preliminary Report on Patentability issued in International Application No. PCT/US2015/025754, dated Oct. 27, 2016.
International Preliminary Report on Patentability issued in International Application No. PCT/IB2015/001477, dated Oct. 27, 2016.
International Search Report dated Feb. 5, 2016, issued In corresponding International Application No. PCT/US2015/055667.
Written Opinion of the International Searching Authority dated Feb. 5, 2016, issued in corresponding International Application No. PCT/US2015/055667.
International Search Report dated Feb. 26, 2016, issued in corresponding International Application No. PCT/US2015/066290.
Written Opinion of the International Searching Authority dated Feb. 26, 2016, issued in corresponding International Application No. PCT/US2015/066290.
International Preliminary Report and Written Opinion of the International Searching Authority dated Apr. 27, 2017, issued in corresponding International Application No. PCT/US2015/055667.
International Preliminary Report on Patentability issued in International Application No. PCT/US2015/066290, dated Jun. 20, 2017.
Non-Final Office Action dated Aug. 2, 2017 in copending U.S. Appl. No. 14/883,980.
Third Party Observation issued in European Application No. 15791025.8 dated Aug. 18, 2017.
Ampoule, from Wikipedia, the free encyclopedia, retrieved from https://en.wikipedia.org/w/index/php?title=Ampoule&oldid=784220607, page last edited Jun. 7, 2017.
Vial, from Wikipedia, the free encyclopedia, retrieved from https://en.wikipedia.org/w/index/php?title=Vial&oldid=771730942, page last edited Mar. 23, 2017.
Chinese Office Action dated Aug. 30, 2017 for corresponding Chinese Patent Application No. 201580031588.
Office Action for copending U.S. Appl. No. 14/686,519 dated Jun. 7, 2017.
Search Report for corresponding European App. No. 15791025.8 dated Nov. 2, 2017.
Third Party observations for corresponding European App. No. 15791025.8 dated Oct. 27, 2017.
"E cigarette labeling machine" uploaded by Cherry Wang, Sep. 1, 2014 [retrieved on Feb. 1, 2016]; Retrieved from the Internet: <URL:https://www.youtube.com/watch?v=7uFodYd0xTI>. times 0:00s to 0:30s.
"Labeling machine auto labeler equipment for Electronic cigarette" uploaded by Penglai Industrial Corporation Limited, Sep. 17, 2013 [retrieved Feb. 1, 2016]: Retrieved from the Internet: <URL:https://www.youtube.com/watch?v=zKyXiOYS8_Y>. time 0:00s to 1:10s.
Office Action for corresponding Eurasian Application No. 201692054 dated Jul. 26, 2018 and English translation thereof.
European Office Action dated Sep. 28, 2018 in corresponding Application No. 15 791 025.8.
Search Report for corresponding European Application No. 15871050.9 dated Jul. 23, 2018.
Chinese Office Action dated Sep. 17, 2018 for corresponding Chinese Application No. 201580031565.9.
Office Action for corresponding Eurasian Application No. 201692055 dated Feb. 20, 2019.
Chinese Office Action dated Jun. 5, 2019, issued in corresponding Chinese Patent Application No. 201580055337.5.
Office Action for corresponding U.S. Appl. No. 14/972,791 dated Apr. 5, 2019.
Office Action for corresponding Eurasian Application No. 201791107 dated Jan. 30, 2019 and English translation.
Office Action for corresponding U.S. Appl. No. 14/972,791 dated Oct. 22, 2019.

(56) References Cited

OTHER PUBLICATIONS

Office Action for corresponding U.S. Appl. No. 15/869,615 dated Nov. 5, 2019.
U.S. Notice of Allowance dated Mar. 26, 2020 for corresponding U.S. Appl. No. 15/978,321.
U.S. Notice of Allowance dated Feb. 12, 2020 for corresponding U.S. Appl. No. 15/869,615.
Office Action for corresponding U.S. Appl. No. 15/978,321 dated Feb. 13, 2020.
Notice of Allowance of U.S. Appl. No. 14/972,791 dated Aug. 20, 2020.
Non-Final Office Action dated Feb. 9, 2022 in co-pending U.S. Appl. No. 16/918,639.
Notice of Allowance for U.S. Appl. No. 16/918,639 dated Jul. 20, 2022.
Office Action for U.S. Appl. No. 17/103,226 dated Jun. 9, 2021.
Office Action for U.S. Appl. No. 16/877,706 dated Jun. 8, 2021.
Notice of Allowance for U.S. Appl. No. 17/103,226 dated Oct. 20, 2021.

* cited by examiner

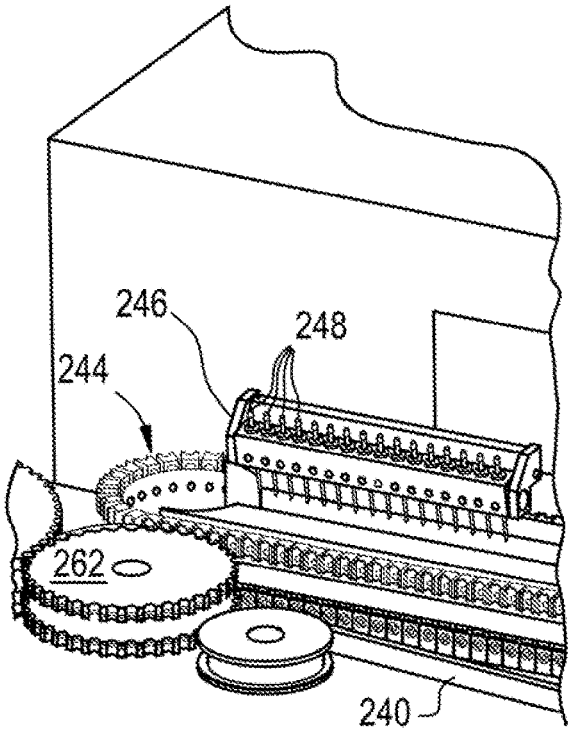
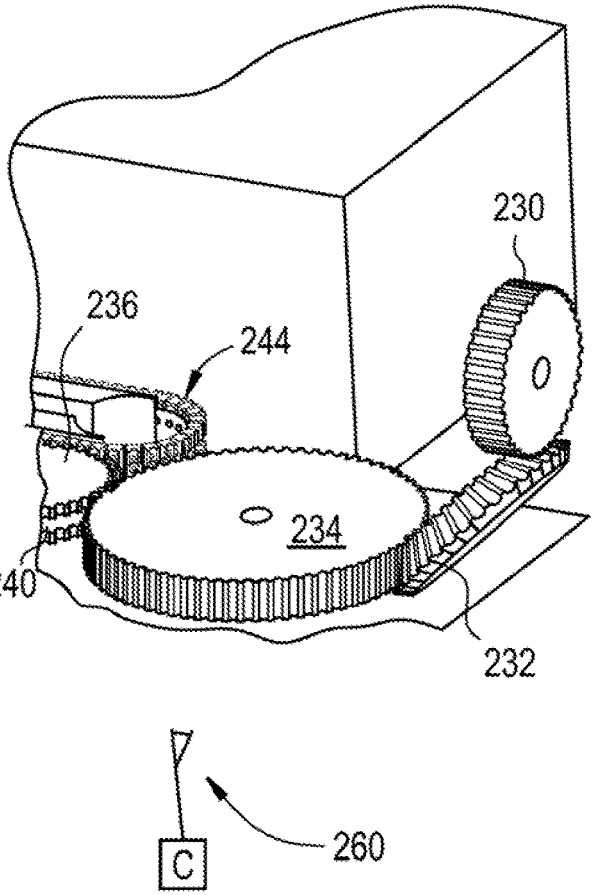
FIG. 10b
FIG. 10a

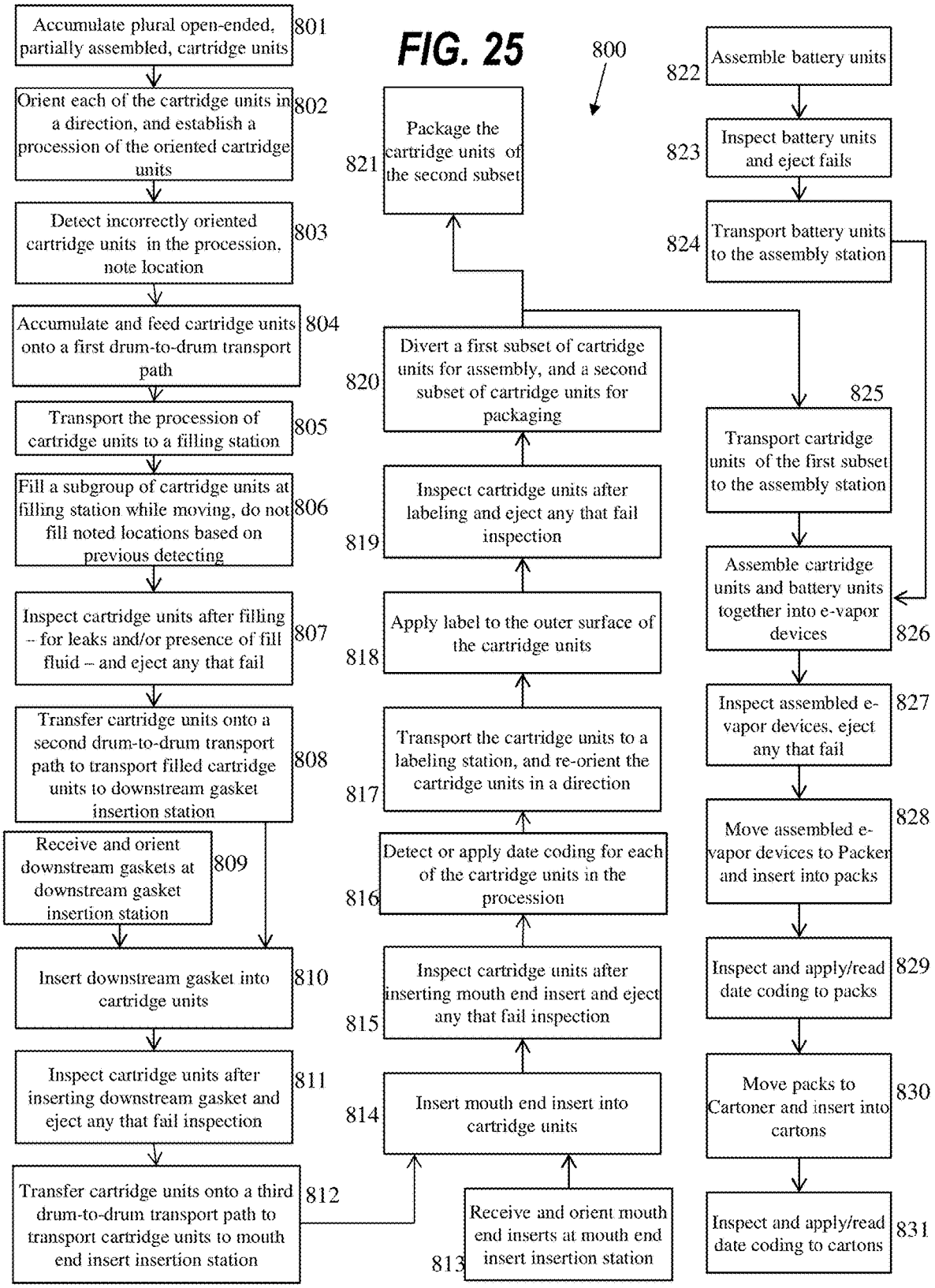
FIG. 25
800
801 Accumulate plural open-ended, partially assembled, cartridge units
802 Orient each of the cartridge units in a direction, and establish a procession of the oriented cartridge units
803 Detect incorrectly oriented cartridge units in the procession, note location
804 Accumulate and feed cartridge units onto a first drum-to-drum transport path
805 Transport the procession of cartridge units to a filling station
806 Fill a subgroup of cartridge units at filling station while moving, do not fill noted locations based on previous detecting
807 Inspect cartridge units after filling – for leaks and/or presence of fill fluid – and eject any that fail
808 Transfer cartridge units onto a second drum-to-drum transport path to transport filled cartridge units to downstream gasket insertion station
809 Receive and orient downstream gaskets at downstream gasket insertion station
810 Insert downstream gasket into cartridge units
811 Inspect cartridge units after inserting downstream gasket and eject any that fail inspection
812 Transfer cartridge units onto a third drum-to-drum transport path to transport cartridge units to mouth end insert insertion station
813 Receive and orient mouth end inserts at mouth end insert insertion station
814 Insert mouth end insert into cartridge units
815 Inspect cartridge units after inserting mouth end insert and eject any that fail inspection
816 Detect or apply date coding for each of the cartridge units in the procession
817 Transport the cartridge units to a labeling station, and re-orient the cartridge units in a direction
818 Apply label to the outer surface of the cartridge units
819 Inspect cartridge units after labeling and eject any that fail inspection
820 Divert a first subset of cartridge units for assembly, and a second subset of cartridge units for packaging
821 Package the cartridge units of the second subset
822 Assemble battery units
823 Inspect battery units and eject fails
824 Transport battery units to the assembly station
825 Transport cartridge units of the first subset to the assembly station
826 Assemble cartridge units and battery units together into e-vapor devices
827 Inspect assembled e-vapor devices, eject any that fail
828 Move assembled e-vapor devices to Packer and insert into packs
829 Inspect and apply/read date coding to packs
830 Move packs to Cartoner and insert into cartons
831 Inspect and apply/read date coding to cartons

METHOD AND SYSTEM FOR THE AUTOMATED PRODUCTION OF E-VAPOR DEVICES

CROSS-REFERENCE TO RELATED APPLICATION

This application claims priority under 35 U.S.C. § 119(e) to U.S. Provisional Application No. 61/979,326, filed Apr. 14, 2014, the entire contents of which is incorporated herein by reference.

BACKGROUND

Field

This disclosure relates generally to systems and methods of automated manufacture of vapor-generating articles and, more particularly, to systems and methods of automated manufacturing of electronic vaping devices.

Description of the Related Art

Conventionally, electronic vapor-generating articles are manufactured via a number of manual operations. However, such operations are not only labor intensive and time consuming but also more prone to inconsistency.

SUMMARY

Some example embodiments described herein are directed to the automated manufacturing of electronic vapor-generating devices, such as electronic vaping devices, articles, apparatuses, instruments, and other forms regardless of their size and shape.

Some example embodiments are directed to methods and systems for automating the assembly of a cartomizer section (also called a cartridge unit) of an electronic vaping device, including automated processes for filling a liquid reservoir in the cartomizer section, inserting a gasket in the cartomizer section, inserting a mouth end insert in the cartomizer section, and applying a label around the cartomizer section. In accordance with aspects described herein, these automated processes are performed using rotating fluted drums and/or fluted belts that transport cartomizer sections between stages of an assembly line, and with quality control inspections after each of the stages.

In an example embodiment, a method for automated manufacturing of e-vapor devices may include organizing a feed of cartridge units of the e-vapor devices into a procession of cartridge units moving along an assembly path; supplying the cartridge units with a liquid while the cartridge units are moving on a first fluted transport section of the assembly path; sealing the cartridge units with the liquid therein while the cartridge units are moving on a second fluted transport section of the assembly path; and inspecting the cartridge units before or after at least one of the organizing, supplying, and sealing and, based on results of the inspecting, ejecting non-compliant units from the procession of the cartridge units moving along the assembly path.

The organizing step may include orienting an open end of each of the cartridge units in a same upward direction. The organizing may also include using a vacuum to maintain a position of each of the cartridge units within a fluted surface of at least one of the first fluted transport section and the second fluted transport section of the assembly path. The supplying step may include inserting a needle into each of the cartridge units, the needle being positioned adjacent to a periphery thereof prior to injecting the liquid. The sealing step may include inserting a gasket into each of the cartridge units so as to be positioned above the liquid therein. The sealing step may further include inserting a mouthpiece into each of the cartridge units. The inspecting step may include optically detecting the cartridge units for at least one of damage, misorientation, spillage, leakage, and misassembly. The inspecting step may additionally include testing a resistance to draw (RTD) of each of the cartridge units. The inspecting step may also include performing an electrical continuity test on each of the cartridge units. The ejecting may be performed with a jet of air through a fluted surface of the assembly path and/or by interrupting or disabling the vacuum at the fluted surface when the fluted surface reaches an ejection/rejection station.

In another example embodiment, a system for automated manufacturing of e-vapor devices may include a feed source of cartridge units of the e-vapor devices; an assembly path connected to the feed source, the assembly path defined by at least a plurality of fluted surfaces, the plurality of fluted surfaces configured to receive the cartridge units and to engage in an endless motion so as to produce a procession of the cartridge units through the assembly path; a filling station arranged downstream from the feed source on the assembly path, the filling station configured to supply the procession of the cartridge units with a liquid while the cartridge units are moving on a first fluted transport section of the assembly path; a sealing station arranged downstream from the filling station on the assembly path, the sealing station configured to insert a sealing element into each of the cartridge units to seal the liquid therein while the cartridge units are moving on a second fluted transport section of the assembly path; and an inspection station arranged downstream from the feed source on the assembly path, the inspection station configured detect and eject non-compliant units from the procession of the cartridge units moving along the assembly path.

The feed source may be configured to orient the cartridge units in a same direction. The assembly path may include a plurality of drums including the plurality of fluted surfaces, the plurality of drums arranged to perform a drum-to-drum transfer of the cartridge units to advance the procession. Each of the plurality of fluted surfaces may be in a form of a groove having a shape configured to correspond to an outer surface of a corresponding one of the cartridge units. Each of the plurality of fluted surfaces may include a port opening extending therethrough, the port opening configured to draw a vacuum to hold a corresponding one of the cartridge units against a receiving one of the plurality of fluted surfaces. The plurality of fluted surfaces may be covered with a resilient material, the resilient material being more yielding and/or less dense than a constituent material of the plurality of fluted surfaces. The plurality of fluted surfaces may define at least one of the first fluted transport section and the second fluted transport section of the assembly path are arranged in parallel. The sealing station may be configured to insert at least one of a gasket and a mouthpiece as the sealing element. The detecting station may be configured to eject the non-compliant units with a jet of air through a corresponding one or more of the plurality of fluted surfaces of the assembly path and/or by interrupting or disabling the vacuum at the fluted surface when the fluted surface reaches an ejection/rejection station.

In accordance with another example embodiment, a method of automated manufacturing of electronic vapor-generating articles may include establishing a procession of partially assembled, oriented cartridge units of the electronic vapor-generating articles in an assembly path; preparing the cartridge units for filling while the cartridge units are moving on a first drum-to-drum transport path of the assembly path; adding liquid to the cartridge units while the cartridge units are moving in a filling workstation of the assembly path; preparing the cartridge units for sealing while the cartridge units are moving on a second drum-to-drum transport path of the assembly path; and sealing the cartridge units while the cartridge units are moving in a sealing workstation of the assembly path.

According to another example embodiment, a method of automated manufacturing of electronic vapor-generating articles may include receiving partially-assembled, open-ended cartridge units of the electronic vapor-generating articles in a random orientation; establishing a procession of the cartridge units; adding liquid to the cartridge units while the cartridge units are moving on an endless belt; and inserting a respective sealing element into each of the cartridge units while the cartridge units are carried on a rotatable turret.

According to another example embodiment, a system for the automated manufacturing of electronic vapor-generating articles may include an assembly path comprising a filling workstation that is structured and arranged to add liquid to cartridge units of the electronic vapor-generating articles while the cartridge units are moving in an procession; a sealing workstation that is structured and arranged to insert a respective sealing element into each of the cartridge units while the cartridge units are moving in the procession; a first drum-to-drum transport path that moves the cartridge units to the filling workstation; and a second drum-to-drum transport path that moves the cartridge units from the filling workstation to the sealing workstation.

According to another example embodiment, a method of automated manufacturing of electronic vapor-generating articles may include establishing a procession of oriented cartridge units of the electronic vapor-generating articles on a first drum-to-drum transport path; moving the procession from the first drum-to-drum transport path onto a first conveyor at a filling workstation; adding liquid to the cartridge units of the procession while the cartridge units are moving on the first conveyor at the filling workstation; moving the procession from the first conveyor at the filling workstation to a second drum-to-drum transport path; moving the procession from the second drum-to-drum transport path to a second conveyor at a sealing workstation; and inserting respective sealing elements into the cartridge units of the procession while the cartridge units are moving on the second conveyor at a sealing workstation.

According to another example embodiment, a method of automated manufacturing of electronic vapor-generating articles may include establishing a procession of partially assembled, oriented cartridge units of the electronic vapor-generating articles in an assembly path; preparing the cartridge units for filling while the cartridge units are moving on a first drum-to-drum transport path of the assembly path; adding liquid to the cartridge units while the cartridge units are moving in a filling workstation of the assembly path; preparing the cartridge units for sealing while the cartridge units are moving on a second drum-to-drum transport path of the assembly path; and sealing the cartridge units while the cartridge units are moving in a sealing workstation of the assembly path. The preparing the cartridge units for filling may include performing an orientation inspection of each of the cartridge units; ejecting improperly oriented cartridge units from the procession based on the orientation inspection; performing a damage inspection of each of the cartridge units; and ejecting damaged cartridge units from the procession based on the damage inspection. The preparing the cartridge units for sealing may include performing a filling inspection of each of the cartridge units; and ejecting improperly filled cartridge units from the procession based on the filling inspection. The method may also include at least one of accumulating the cartridge units in a first accumulator in the assembly path after the establishing the procession and prior to the adding the liquid; and accumulating the cartridge units in a second accumulator in the assembly path after the adding the liquid and prior to the sealing.

According to another example embodiment, an automated method of assembling components of an electronic vapor-generating article may include establishing an oriented procession of a first component of the electronic vapor-generating article; and executing an assembly operation upon said procession at a work station by moving said procession along a path to said work station using drum to drum transfer. The drum to drum transfer may include vacuum retaining each member of said procession upon a flute of a rotatable drum portion by communicating vacuum through a port provided in said flute; and sealing the communicated vacuum with a resilient material disposed on the rotatable drum portion adjacent said port, whereby said vacuum retention is enhanced. The method may also include preparing said first components for said assembly operation by inspecting, ejecting and optionally accumulating said first components along said path.

According to another example embodiment, an automated method of assembling components of an article may include establishing a procession of a first component of the article; and executing an assembly operation upon said procession at a work station by moving said procession along a path to said work station using drum to drum transfer. The drum to drum transfer includes vacuum retaining each member of said procession upon a flute of a rotatable drum portion by communicating vacuum through a port provided in said flute; and sealing the communicated vacuum with a resilient material disposed on said rotatable drum portion adjacent said port, whereby said vacuum retention is enhanced.

According to another example embodiment, a drum to drum transfer system may include a series of rotating drums arranged to move a procession of articles along a path using drum to drum transfer. Each said drum in the series of rotating drums retains a member of said procession upon a flute of a rotatable drum portion by communicating a vacuum through a port provided in said flute and sealing the communicated vacuum with a resilient material disposed on said rotatable drum portion adjacent said port, whereby said vacuum retention is enhanced.

According to another example embodiment, a transfer drum may include a rotatable drum portion comprising a plurality of spaced apart flutes and a port at a location along each flute; an arrangement to communicate vacuum through said port; and a resilient material disposed on said rotatable drum portion adjacent said port, whereby said vacuum retention is enhanced.

BRIEF DESCRIPTION OF THE DRAWINGS

Various aspects are further described in the detailed description which follows, in reference to the noted plurality of drawings by way of non-limiting examples of embodiments, in which like reference numerals represent similar parts throughout the several views of the drawings.

FIGS. 8, 9*a*, 9*b*, 9*c*, 10*a*, and 10*b* show aspects of a system for performing automated processing steps in accordance with an example embodiment, wherein FIG. 8 is a side view representation of a sub-system for establishing a moving procession of oriented cartridge units;

FIGS. 18-21, 22*a*, 22*b*, 23, 24*a*, and 24*b* show additional aspects of a system for performing automated processing steps in accordance with an example embodiment, wherein FIG. 22*a* is a top view representation and FIG. 22*b* is a side view representation; and FIG. 25 shows a flow diagram of an automated production process in accordance with an example embodiment.

DETAILED DESCRIPTION

Figure 1A:
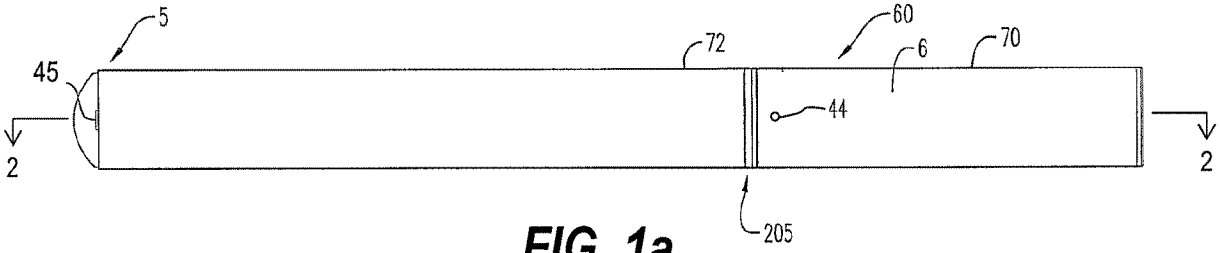
FIGS. 1*a* and 1*b* are views of electronic vaping devices according to an example embodiment.

Various aspects will now be described with reference to specific forms selected for purposes of illustration. It will be appreciated that the spirit and scope of the apparatus, system and methods disclosed herein are not limited to the selected forms. Moreover, it is to be noted that the figures provided herein are not drawn to any particular proportion or scale, and that many variations can be made to the illustrated forms. Reference is now made to FIGS. 1*a*-25, wherein like numerals are used to designate like elements throughout.

Each of the following terms written in singular grammatical form "a," "an," and "the," as used herein, may also refer to, and encompass, a plurality of the stated entity or object, unless otherwise specifically defined or stated herein, or, unless the context clearly dictates otherwise. For example, the phrases "a device," "an assembly," "a mechanism," "a component," and "an element," as used herein, may also refer to, and encompass, a plurality of devices, a plurality of assemblies, a plurality of mechanisms, a plurality of components, and a plurality of elements, respectively.

Each of the following terms "includes," "including," "has," "having," "comprises," and "comprising," and, their linguistic or grammatical variants, derivatives, and/or conjugates, as used herein, means "including, but not limited to."

Throughout the illustrative description, the examples, and the appended claims, a numerical value of a parameter, feature, object, or dimension, may be stated or described in terms of a numerical range format. It is to be fully understood that the stated numerical range format is provided for illustrating implementation of the forms disclosed herein, and is not to be understood or construed as inflexibly limiting the scope of the forms disclosed herein.

Moreover, for stating or describing a numerical range, the phrase "in a range of between about a first numerical value and about a second numerical value," is considered equivalent to, and means the same as, the phrase "in a range of from about a first numerical value to about a second numerical value," and, thus, the two equivalently meaning phrases may be used interchangeably.

It is to be understood that the various forms disclosed herein are not limited in their application to the details of the order or sequence, and number, of steps or procedures, and sub-steps or sub-procedures, of operation or implementation of forms of the method or to the details of type, composition, construction, arrangement, order and number of the system, system sub-units, devices, assemblies, sub-assemblies, mechanisms, structures, components, elements, and configurations, and, peripheral equipment, utilities, accessories, and materials of forms of the system, set forth in the following illustrative description, accompanying drawings, and examples, unless otherwise specifically stated herein. The apparatus, systems and methods disclosed herein can be practiced or implemented according to various other alternative forms and in various other alternative ways.

It is also to be understood that all technical and scientific words, terms, and/or phrases, used herein throughout the present disclosure have either the identical or similar meaning as commonly understood by one of ordinary skill in the art, unless otherwise specifically defined or stated herein. Phraseology, terminology, and, notation, employed herein throughout the present disclosure are for the purpose of description and should not be regarded as limiting.

Example embodiments are described herein in a non-limiting manner with reference to electronic vaping devices. However it should be understood that the various aspects described herein may be used in manufacturing any type of electronic vapor-generating devices, articles, apparatuses, and instruments, regardless of size and shape.

Electronic Vaping Device Layout

Figure 2:
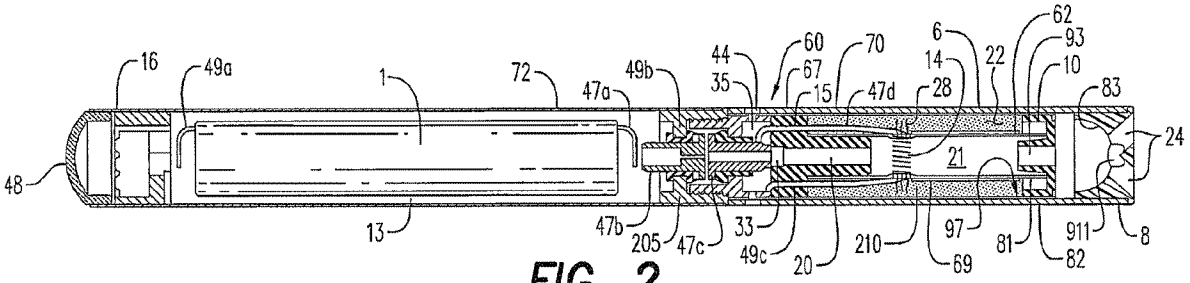
FIG. 2 is a side cross-sectional view of the electronic vaping device shown in FIG. 1*a* or 1*b;*

Referring to FIGS. 1*a* and 2, an electronic vaping device 60 comprises a replaceable cartridge (or first section) 70 and a second reusable fixture (or battery section) 72, which in an example embodiment are coupled together at a threaded connection 205 or by other convenience such as a snug-fit, detent, bayonet, clamp and/or clasp. Generally, the second section 72 includes a puff sensor 16 responsive to a draw upon the first section 70 when the sections 70 and 72 are connected. The second section 72 may include a battery 1 and control circuitry. The disposable first section 70 includes a liquid reservoir 22 and a heater 14 that vaporizes the liquid that is drawn from the liquid reservoir 22 through a wick 28. In an example embodiment, the first section 70 comprises a "cartomizer" section. Upon completing the threaded connection 205, the battery 1 is connectable with the electrical heater 14 of the first section 70 upon actuation of the puff sensor. Air is drawn primarily into the first section 70 through one or more air inlets 44 located in the first section 70.

In an example embodiment, once the liquid of the cartridge is spent, only the first section 70 is replaced. An alternate arrangement includes a layout where the entire article 60 is disposed once the liquid supply is depleted. In such case the battery type and other features might be engineered for even greater simplicity and cost-effectiveness, but generally embodies the same concepts as in an example embodiment in which the second section is reused and/or recharged.

The electronic vaping device 60 can be about 80 mm to about 110 mm long (e.g., about 80 mm to about 100 mm long) and about 7 mm to about 10 mm or more in diameter. For example, the electronic vaping device is about 84 mm long and has a diameter of about 7.8 mm. Implementations are not limited to these dimensions, and aspects described herein may be adapted for use with any size electronic vaping device.

At least one adhesive-backed label is applied to the outer tube 6 (also referred to as an outer casing). The label completely circumscribes the electronic vaping device 60 and can be colored and/or textured. In the example embodiment of FIG. 1*a*, in which the one or more air inlet holes are formed in the outer tube 6, the label can include holes therein which are sized and positioned so as to prevent blocking of the air inlets 44. In the example embodiment shown in FIG. 1*b*, the one or more air inlets 44 are located at a structure associated with the threaded connection 205, including but not limited to a connector ring between the first section 70 and the second section 72. In this embodiment, the one or more air inlets 44 are not formed in the outer tube 6. The air inlets 44 are precision machined to as to provide a desired resistance to draw (RTD) precisely and consistently from one article 60 to the next.

The outer tube 6 and/or the inner tube 62 (also referred to as a chimney) may be formed of any suitable material or combination of materials. Examples of suitable materials include metals, alloys, plastics, paper, fiberglass (including woven fiberglass) or composite materials containing one or more of those materials, or thermoplastics that are suitable for food or pharmaceutical applications, for example polypropylene, polyetheretherketone (PEEK), ceramic, and polyethylene. The material may be light and non-brittle.

Figure 3:
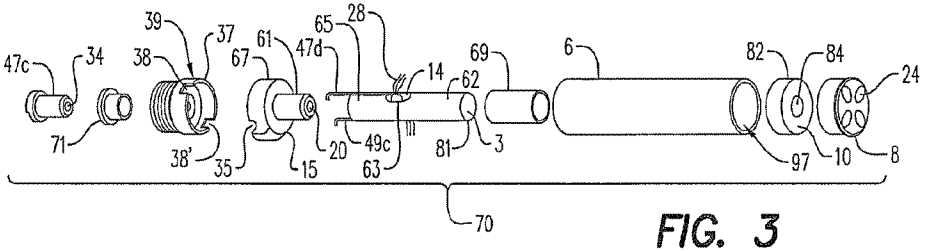
FIG. 3 is an exploded, perspective view of elements comprising the cartridge unit of the electronic vaping device shown in FIG. 1*a* or 1*b;*

Referring now to FIGS. 1-3, the first section 70 includes an outer tube 6 extending in a longitudinal direction and an inner tube (or chimney) 62 coaxially positioned within the outer tube 6. A nose portion 61 of an upstream gasket (or seal) 15 is fitted into an upstream end portion of the inner tube 62, while at the same time, an outer perimeter 67 of the gasket 15 provides a liquid-tight seal with an interior surface of the outer tube 6. The upstream gasket 15 also includes a central, longitudinal air passage 20, which opens into an interior of the inner tube 62 that defines a central channel 21. A transverse channel 33 at a backside potion of the gasket 15 intersects and communicates with the central channel 20 of the gasket 15. This channel 33 assures communication between the central channel 20 and a space 35 (see FIG. 2) defined between the gasket 15 and a cathode connector piece. In an example embodiment, the piece includes a threaded section for effecting the threaded connection 205.

Figure 1B:
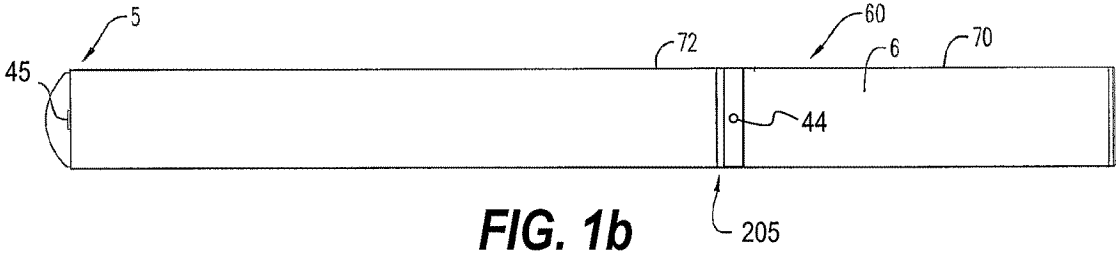

In an example embodiment, the second section 72 includes an air inlet 45 at an upstream end 5 of the electronic vaping device 60, which is sized just sufficient to assure proper operation of the puff sensor 16, located nearby. Drawing action upon the mouth end insert 8 is communicated to the puff sensor 16 through central channels 34 provided in the anode post 47*c* of the first section 70 and the central channel in the anode connection post 47*b* of the second section 72 and along space 13 between the battery 1 and the casing of the second section 72. These channels and the port 45 itself are sized such that the airflow rate there through is much smaller than through the air inlets 44. Referring to FIG. 1*b*, in another embodiment the air inlets 44 are established in an exposed ring portion of the fixture portion of the cartridge unit, instead of at locations in the outer casing 6.

A nose portion 93 of a downstream gasket 10 is fitted into a downstream end portion 81 of the inner tube 62. An outer perimeter 82 of the gasket 10 provides a substantially liquid-tight seal with an interior surface 97 of the outer tube 6. The downstream gasket 10 includes a central channel disposed between the central passage 21 of the inner tube 62 and the interior of the mouth end insert 8 and which communicates the vapor from the central passage 21 to the mouth end insert 8.

The space defined between the gaskets 10 and 15 and the outer tube 6 and the inner tube 62 establish the confines of a liquid reservoir 22. The liquid reservoir 22 comprises a liquid material and optionally a liquid storage medium 210 operable to store (retain and distribute) the liquid material therein. The liquid storage medium 210 may comprise a winding of cotton gauze or other fibrous material about the inner tube 62.

The liquid reservoir 22 is contained in an outer annulus between inner tube 62 and outer tube 6 and between the gaskets 10 and 15. Thus, the liquid reservoir 22 at least partially surrounds the central air passage 21. The heater 14 extends transversely across the central channel 21 between opposing portions of the liquid reservoir 22.

The liquid storage medium 210 is a fibrous material comprising cotton, polyethylene, polyester, rayon and combinations thereof. The fibers have a diameter ranging in size from about 6 microns to about 15 microns (e.g., about 8 microns to about 12 microns or about 9 microns to about 11 microns). The liquid storage medium 210 can be a sintered, porous or foamed material. The fibers are also sized to be irrespirable and can have a cross-section which has a y shape, cross shape, clover shape, or any other suitable shape. In the alternative, the liquid reservoir 22 may comprise a filled tank lacking a fibrous storage medium 21 and containing only liquid material.

The liquid material has a boiling point suitable for use in the electronic vaping device 60. If the boiling point is too high, the heater 14 will not be able to vaporize liquid in the wick 28. However, if the boiling point is too low, the liquid may vaporize even when the heater 14 is not being activated.

The liquid material may include a tobacco-containing material including volatile tobacco flavor compounds which are released from the liquid upon heating. The liquid may also be a tobacco flavor containing material or a nicotine-containing material. Alternatively, or in addition, the liquid may include a non-tobacco material. For example, the liquid may include water, solvents, ethanol, plant extracts and natural or artificial flavors. The liquid further includes a vapor former. Examples of suitable vapor formers are glycerine and propylene glycol.

Aspects include positioning an optional closure ring 69 such that it is proximate to or touches but does not urge against the wick 28. An upstream edge of the closure ring 69 is brought into proximity of the wick 28. The closure ring 69, when positioned in this manner, closes off a remainder of open space provided between the heater coil assembly and the slot 63 and prevents liquid from leaking into the chimney.

Referring to FIGS. 2 and 3, the first section 70 includes a mouth end insert 8 having at least two diverging outlet passages 24, which may be two to six outlet passages 24 (e.g., four outlet passages 24). The outlet passages 24 are located off-axis and are angled outwardly in relation to the central channel 21 of the inner tube 62 (i.e., divergently).

Also, the mouth end insert (or flow guide) 8 includes outlets 24 uniformly distributed about the perimeter of mouth end insert 8 so as to substantially uniformly distribute vapor in an adult vaper's mouth during use and create a perception of greater fullness in the mouth.

Figure 4:
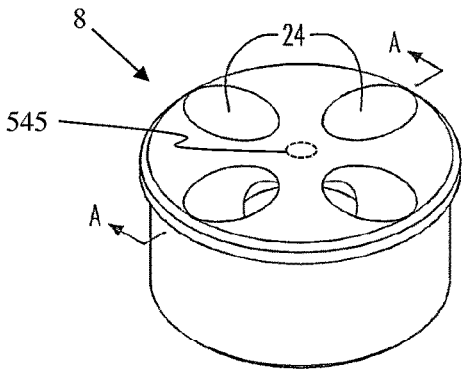
FIG. 4 is a perspective view of the mouth end insert of the electronic vaping device shown in FIG. 1*a* or 1*b;*
Figure 5:
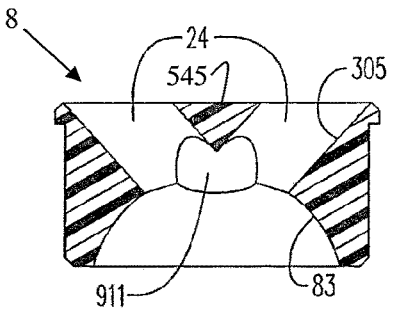
FIG. 5 is a cross-sectional view along line A-A of the mouth end insert of FIG. 4.

Referring to FIGS. 4 and 5, the diverging outlet passages 24 are arranged and include interior surfaces 83 such that droplets of unvaporized liquid material, if any, that may be entrained in the vapor impact the interior surfaces 83 of the mouth end insert 8 and/or impact portions of walls 305 which define the diverging outlet passages 24. As a result such droplets are substantially removed or broken apart, to the enhancement of the vapor.

As shown in FIGS. 2 and 5, an interior surface 83 of the mouth end insert 8 can comprise a generally domed surface 83. The interior surface 83 is substantially uniform over the surface thereof. Moreover, the interior surface 83 can be symmetrical about the longitudinal axis of the mouth end insert 8. However, in other embodiments, the interior surface 83 can be irregular and/or have other shapes.

In an example embodiment, a hollow 911 is disposed at the convergence of the diverging outlet passages 24 within the mouth end insert 8.

As mentioned previously, the multi-port mouth end insert 8 disperses and changes the direction of the vapor as it is drawn from the electronic vaping device 60 so as to provide a fuller mouth feel. As the vapor is formed, it passes through the central channel 21 in the inner tube 62 and through the central channel 84 in the downstream gasket 10.

It is advantageous to provide an electronic vaping device having a downstream gasket 10 having a central channel 84, which has a diameter sufficient to prevent (abate) acceleration of the vapor flow stream before reaching the mouth end insert 8. The diameter of the central channel 84 is about 2.0 mm to about 3.0 mm (e.g., about 2.4 mm to about 2.8 mm). The mouth end insert 8 then divides output from the central channel 84 into multiple divergent streams of reduced speed so as to provide a full mouth feel and to avoid sensations of "hot".

In an example embodiment, the power supply 1 includes a battery arranged in the electronic vaping device 60 such that the anode 47*a* is downstream of the cathode 49*a*. A battery anode post 47*b* of the second section 72 contacts the battery anode 47*a*.

More specifically, electrical connection between the anode 47*a* of the battery 1 and the heater coil 14 in the first section 70 is established through a battery anode connection post 47*b* in the second section 72 of the electronic vaping device 60, an anode post 47*c* of the cartridge 70 and an electrical lead 47*d* connecting a rim portion of the anode post 47*c* with an electrical lead of the heater element 14. Likewise, electrical connection between the cathode 49*a* of the battery 1 and the other lead of the heater coil 14 is established through the threaded connection 205 between a cathode connection fixture 49*b* of the second portion 72 and the cathode connector piece 37 of the first section 70 and from there through an electrical lead 49*c* which electrically connects the fixture 37 to the opposite lead of the heater coil 14. In example embodiments, the cathode 49*a* is connected to a switch controlled by a processor.

Automated Assembly

Aspects of described herein are directed to automated assembly of elements of the first section 70 (also referred to herein as a cartridge unit). In example embodiments, a plurality of partially assembled cartridge units are received or accumulated. As used herein, a partially assembled cartridge unit may be a first component of an electronic vapor-generating article, and more specifically may be a cartridge unit 70 that is assembled in the manner shown in FIG. 2 with the exception that there is no liquid in the liquid reservoir 22, the downstream gasket 10 is not present, and the mouth end insert 8 and the downstream gasket are absent. A partially assembled cartridge unit is open-ended in the sense that the mouth end insert 8 is not present. According to aspects described herein, assembly of the cartridge units is completed by performing the following automated processes on each one of the cartridge units adding liquid to the liquid reservoir 22; inserting the downstream gasket 10 in the outer tube 6; and inserting the mouth end insert 8 in the outer tube 6. The mouth end insert 8 may also be referred to as a "mouthpiece."

Further aspects may also include automated processes for applying a label on the outer surface of outer tube 6. Even further aspects may include automated processes for connecting the assembled cartridge unit 70 to a second section 72, e.g., a battery section. Additional aspects include tracking the location of individual ones of the cartridge units throughout the automated processes described herein, and inspecting the cartridge units during the automated processes described herein. Further aspects include automated execution of quality control tests, including automated testing of RTD.

Figure 6:
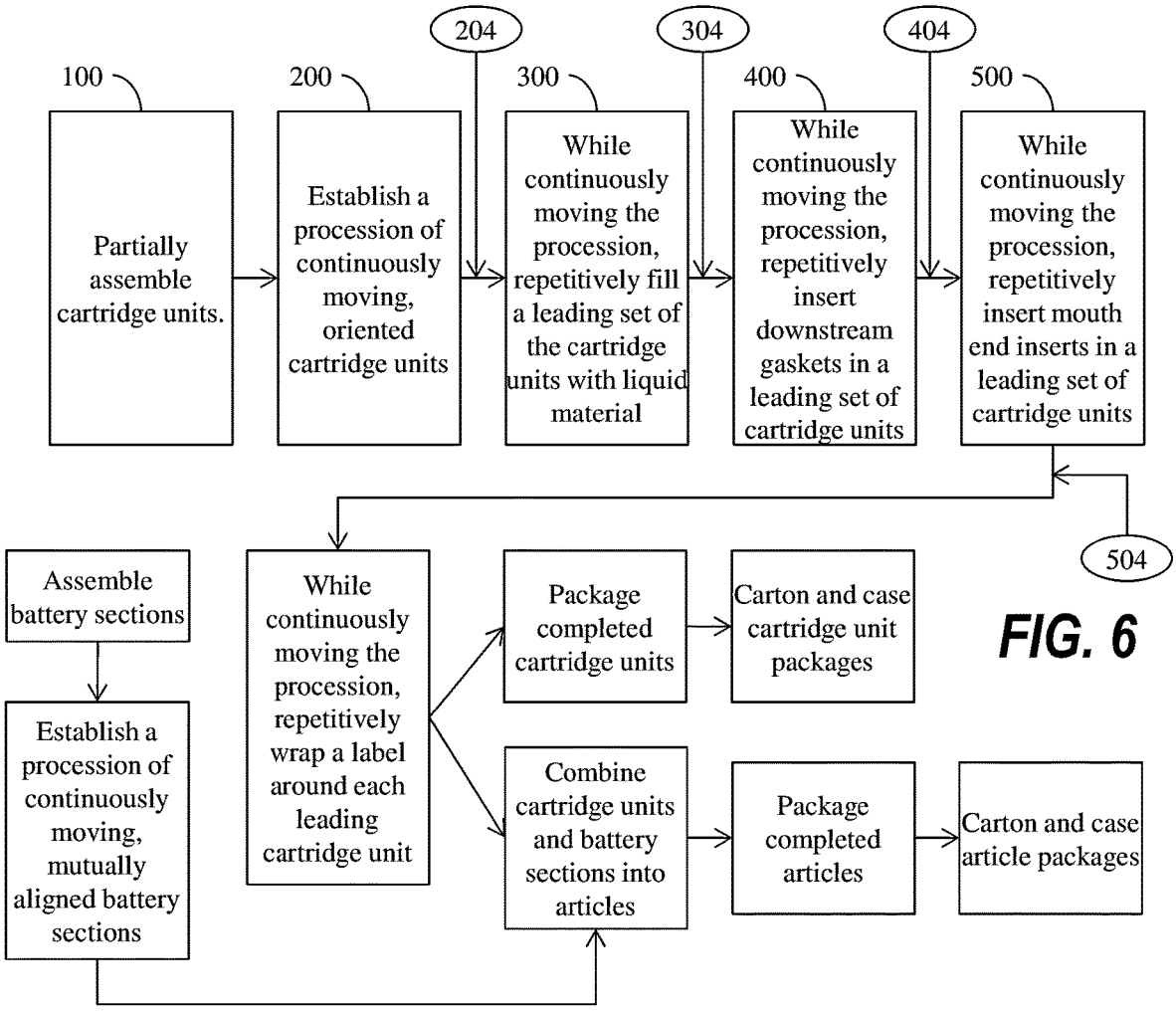
FIG. 6 is a block diagram of an automated production process in accordance with an example embodiment.

FIG. 6 is a block diagram of a process in accordance herewith. In the example shown, the process includes five stages of automated assembly of cartridge units 70. A first stage, step 100, includes assembling and delivering open-ended, partially-assembled cartridge units 70. A second stage, step 200, includes establishing a procession of the open-ended, oriented, partially-assembled cartridge units 70. A third stage, step 300, includes adding liquid to the cartridge units, such as a liquid described with respect to liquid reservoir 22 of FIG. 2. A fourth stage, step 400, includes inserting a downstream gasket 10 into the cartridge units. A fifth stage, step 500, includes inserting a mouth end insert 8 into the cartridge units. Each of the steps is described in greater detail herein. In aspects, the processes performed at steps 200, 300, 400, 500 are automated, e.g., using computer-controlled manufacturing machinery. As described herein, the processes performed at steps 200, 300, 400, 500 may be executed at respective workstations that are contained in an automated assembly path. In additional aspects, the cartridges are handled and transported during and between the workstations for executing steps 200, 300, 400, 500 in an automated manner, e.g., using rotating fluted drums and/or fluted conveyors. In even further aspects, one or more preparing steps (processes) 204, 304, 404, 504 are performed after one or more of steps 100, 200, 300, 400, 500, e.g., to prepare the cartridge units 70 for the next processing step and/or detect, track and/or reject cartridge units 70 that are out of specification.

For example, preparing step 204 may include at least one of inspecting cartridge units 70 for proper orientation, inspecting cartridge units 70 for damage, and performing an RTD test. Preparing step 304 may include inspecting cartridge units 70 to determine whether they have been properly filled. Preparing step 404 may include inspecting cartridge units 70 to determine whether a gasket has been properly inserted. Preparing step 504 may include inspecting cartridge units 70 to determine whether a mouthpiece has been properly inserted. Each preparing step 204, 304, 404, 504 may include rejecting (e.g., ejecting from the procession) any cartridge unit that fails the inspection. The preparing steps 204, 304, 404, 504 are executed while the cartridge units 70 carried on rotating fluted drums and/or fluted conveyors of an assembly path (see, e.g., FIGS. 9*a*, 13, 18, 22*a*, and 24*a*). Each preparing step 204, 304, 404, 504 may additionally or alternatively include automatically accumulating some of the cartridge units 70 between workstations. The accumulating at any of these steps 204, 304, 404, 504 may be accomplished using an accumulator apparatus that is part of the automated assembly path, such as accumulator 225 shown and described with reference to FIG. 8, accumulator 1202 shown and described with reference to FIG. 23, etc.

Figure 7:
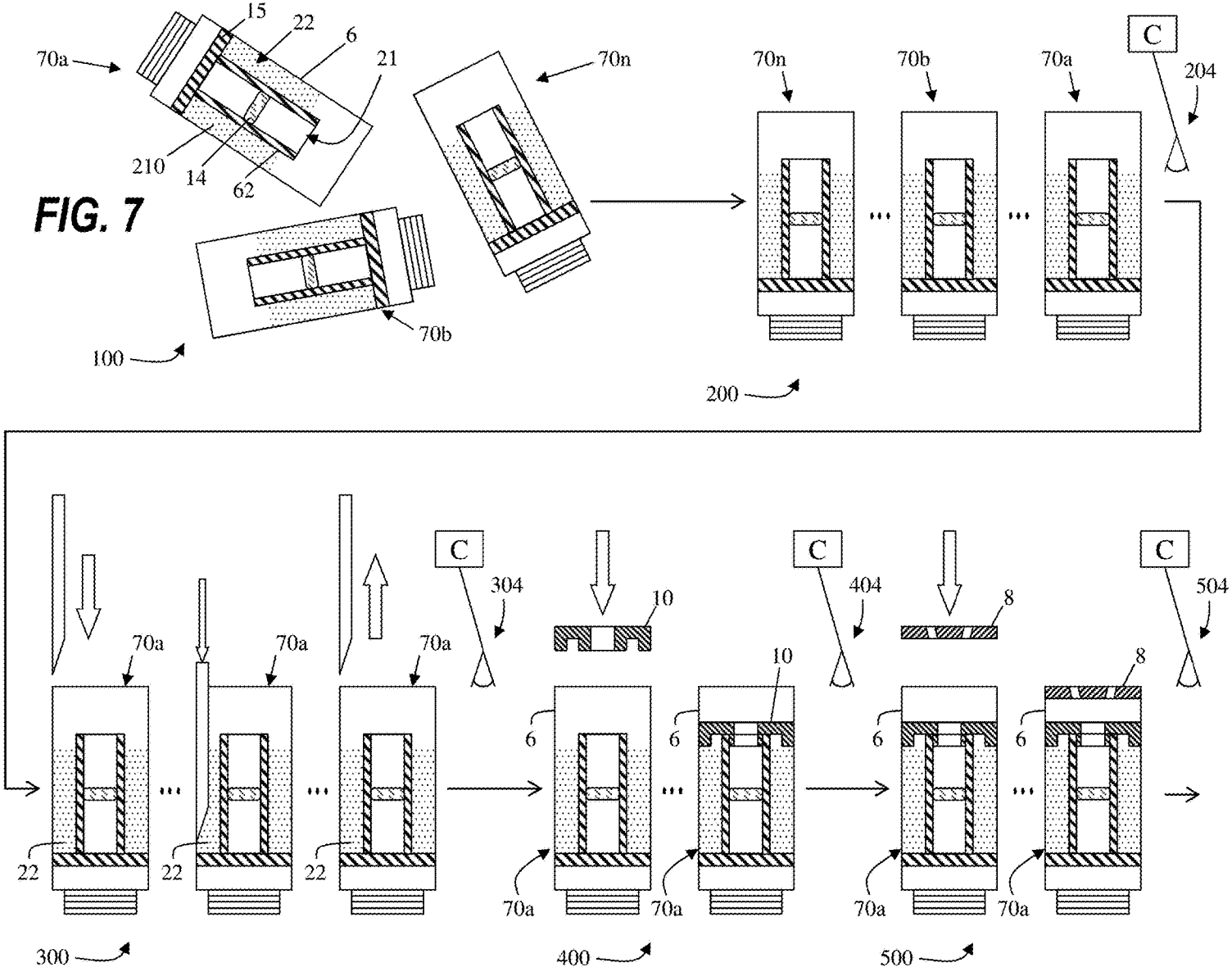
FIG. 7 is a diagrammatic depiction of a procession of cartridge units undergoing automated processing steps in accordance with an example embodiment.

FIG. 7 is a diagrammatic depiction of cartridge units undergoing automated processing steps 100, 200, 300, 400, 500 as described with respect to FIG. 6. At step 100, a plurality of open-ended, partially-assembled cartridge units 70*a*, 70*b*, . . . , 70*n*, are assembled and delivered to an assembly facility or are assembled at the same facility. The cartridge units 70*a-n* may be the same as first section 70 shown in FIG. 2, with the exception that the cartridge units 70*a-n* do not have liquid in the liquid reservoir 22, do not have a downstream gasket 10, and do not have a mouth end insert 8. For example, each one of the cartridge units 70*a-n* may include an outer tube 6, inner tube 62 having a central channel 21, a heater 14, a liquid reservoir 22, (optionally) a liquid storage medium 210, and an upstream gasket 15. Other elements shown in FIG. 2 are omitted for clarity of illustration. The cartridge units 70*a-n* may be partially assembled prior to step 100 in any suitable manner, including, for example, manually or via automation. The cartridge units 70*a-n* may be partially assembled prior to step 100 at any suitable location, including, for example, a remote location that is separate from the location where steps 100, 200, 300, 400, 500 are performed.

With continued reference to FIG. 7, at step 100 the cartridge units 70*a-n* may be delivered in random orientation, e.g., a plurality of cartridge units loosely packaged in a carton, box, drum, etc. In other embodiments, the open-ended cartridge units 70*a-n* are assembled in line with the other workstations of the processes described herein. At step 200, the cartridge units 70*a-n* are oriented in a common direction (i.e., all cartridge units "oriented" to have their open end pointed in a same direction) and arranged in a procession (e.g., a single-file line). As described in greater detail herein, step 200 may be accomplished using a bowl feeder, a conveyor (e.g., a fluted belt) for receiving the output of the bowl feeder, and an accumulator at the terminums of the conveyor, for example. At step 300, a liquid is introduced to the liquid reservoir 22 of respective leading ones of the cartridge units 70*a-n*. As generally depicted in FIG. 7, and as described in greater detail herein, step 300 may be accomplished using a system that moves a needle into the liquid reservoir 22 and injects a predetermined amount of liquid into the liquid reservoir 22. FIG. 7 depicts three successive steps of providing fluid to a cartridge unit 70*a*, but it is understood that fluid may be simultaneously provided to plural cartridge units.

At step 400, a downstream gasket 10 is inserted in the interior of outer tube 6. FIG. 7 depicts two successive steps of inserting a downstream gasket 10 into one cartridge unit 70*a*, but it is understood that plural respective downstream gaskets 10 may be simultaneously inserted into plural respective cartridge units. For example, as described in greater detail herein, step 400 may be accomplished using a system that accumulates a plurality of downstream gaskets 10, aligns a plurality of downstream gaskets 10 with a leading plurality of cartridge units 70, and moves the plurality of downstream gaskets 10 into the leading plurality of cartridge units 70.

At step 500, a mouth end insert 8 is inserted into the end of outer tube 6. FIG. 7 depicts two successive steps of inserting a mouth end insert 8 into one cartridge unit 70*a*, but it is understood that plural respective mouth end inserts 8 may be simultaneously inserted into plural respective cartridge units. For example, as described in greater detail herein, step 500 may be accomplished using a system that accumulates a plurality of mouth end inserts 8, aligns the plurality of mouth end inserts 8 with a leading plurality of cartridge units 70, and moves the plurality of mouth end inserts 8 into the leading plurality of cartridge units 70.

Still referring to FIG. 7, preparing steps 204, 304, 404, 504 may be performed after steps 200, 300, 400, 500, respectively. As described in greater detail herein, the preparing steps may include inspections that detect empty spaces in the procession (e.g., missing cartridge units). The inspections may include detecting cartridge units that are not in compliance with a specification, e.g., a leaking cartridge unit, etc. The inspections may include detecting encoding on the cartridge units and/or applying encoding to the cartridge units, e.g., for tracking cartridge units. The inspections may be automated, i.e., performed using detector elements and a controller "C". As described herein, the controller "C" may be a computer-based controller that employs hardware and software to perform automated tracking and control processes. The inspections may include, for example, an RTD test, a test for proper orientation, a test to confirm proper operation of an inspection station and/or rejection station, etc.

Figure 8:
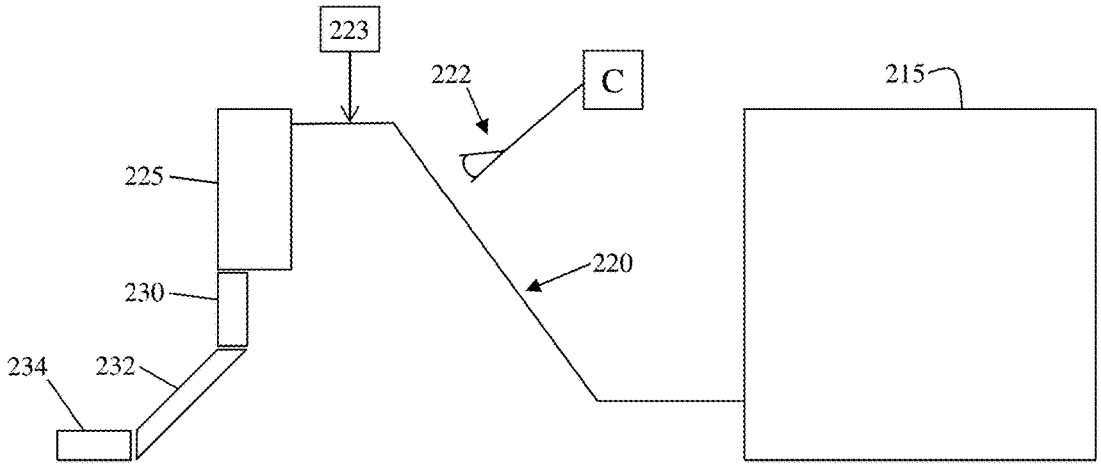

FIG. 8 shows aspects of a system for performing steps 100 and 200, which include receiving a plurality of cartridge units, orienting the cartridge units in a common direction, and arranging the cartridge units in a procession, e.g., a single file line. In example embodiments, a plurality of partially assembled cartridge units 70 are delivered to a bowl feeder 215, which may be a centrifugal bowl feeder such as that manufactured by any of VIBROMATIC CO., INC. of Noblesville, Ind., RNA AUTOMATION LTD of Birmingham, United Kingdom, and SHIBUYA HOPPMAN CORPORATION of Elkwood, Va., for example. The bowl feeder 215 may be configured to orient and load the cartridge units onto a conveyor as a procession of horizontally disposed, oriented cartridge units. In aspects, the cartridge units are arranged one after another horizontally on flutes of the conveyor 220, i.e., with a central longitudinal axis of the outer casing 6 being substantially horizontal. The bowl feeder 215 and conveyor 220 are structured and arranged such that the cartridge units are all oriented in a same direction on individual flutes of the conveyor 220, i.e., such that the open end of each cartridge unit is pointed in a same direction relative to the conveyor 220. The cartridge units thus arranged (as on the conveyor 220) constitute a procession of "oriented" cartridge units.

Still referring to FIG. 8, the system may include a detector 222 that is used in an inspection of the cartridge units arranged in the procession. The detector 222 may include an optical detector, such as one or more cameras that view the cartridge units in the procession. The camera(s) may be connected to a controller "C" that is adapted to determine incorrectly oriented and/or improperly assembled or damaged cartridge units based on the image(s) provided by the camera(s). The inspection may be carried out using the detector 222 and the controller "C" and may comprise detecting incorrectly oriented cartridge units in the procession. The inspection may also comprise detecting cartridge units that are not properly assembled, i.e., that are missing parts or damaged. In both cases, the system may include an ejection station comprising a rejection mechanism 223 that removes the detected incorrectly oriented and/or improperly assembled or damaged cartridge unit from the procession. For example, the rejection mechanism 223 may include a controlled air jet and/or an actuator that is configured to eject any incorrectly oriented and/or improperly assembled cartridge units from the conveyor 220. The actuator may be configured to selectively interrupt or disable the vacuum at the flute and/or may be configured to selectively provide a mechanical force to a non-compliant cartridge unit that is sufficient to overcome the vacuum at the flute.

The inspection may also include at least one of applying information to and detecting information on each of the cartridge units in the procession. For example, each cartridge unit may be encoded with information such as date of manufacture, unique tracking identification, authentication, lot number, facility identification, and model number. More specifically, the individual cartridge units may be printed with indicia that provide such information. In the alternative, the system may include a device, such as a camera or bar code reader that reads encoded information that may be already printed on each of the cartridge units as the cartridge units move on the conveyor 220. The system may optionally include a device that applies such indicia to each of the cartridge units as the cartridge units move on the conveyor 220. A code-application device may be located at a location downstream of the filling workstation, such as after the filling workstation and any inspection and rejection of units after filling (e.g., after the filling and insertion steps 300, 400, and 500 and any inspections associated with these steps).

In example embodiments, the conveyor 220 delivers the cartridge units to an accumulator 225 that serves as a buffer between the conveyor 220 and a filling workstation. The accumulator 225 may comprise, for example, a zig-zag or S-shaped pathway through which the cartridge units travel between an accumulator inlet and an accumulator outlet. The accumulator inlet may be vertically higher than the accumulator outlet such that the cartridge units travel through the accumulator via gravity. In aspects, the accumulator 225 maintains the cartridge units in a same orientation as when the cartridge units are arranged on the conveyor. The accumulator 225 may be sized to receive cartridge units at the accumulator inlet at a faster rate than cartridge units are released at the accumulator outlet. In this manner, the accumulator 225 provides a buffer that compensates for empty slots in the procession, i.e., cartridge units that were ejected from the procession based on the inspection step or missing in the procession as a result of inconsistent loading at the bowl feeder 215. Advantageously, the accumulator maintains the common orientation of units in the procession, but removes any gaps (missing units) in the procession due, e.g., to a faulty feeding and/or rejection of units upon inspection. In example embodiments, a rotating drum 230 with flutes around its outer perimeter (e.g., a fluted drum) receives cartridge units from the outlet of the accumulator 225.

Figure 9A:
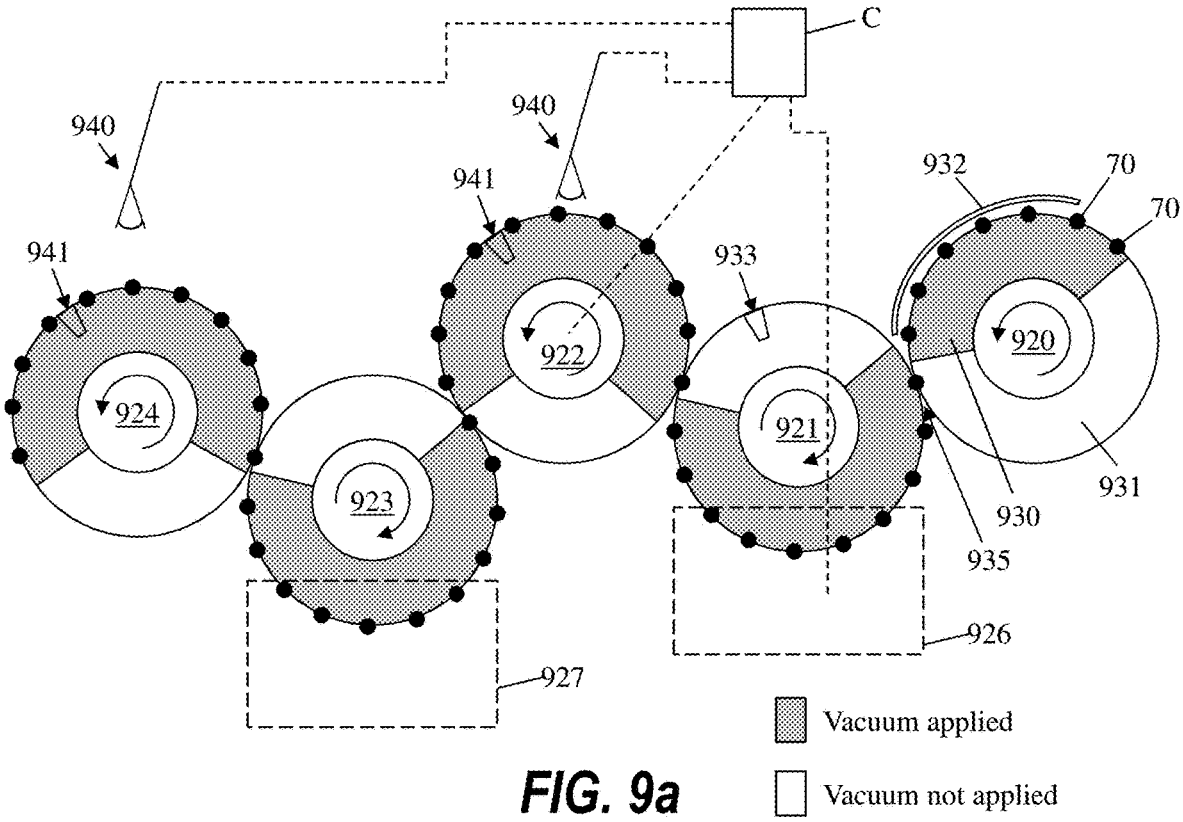
Figure 9B:
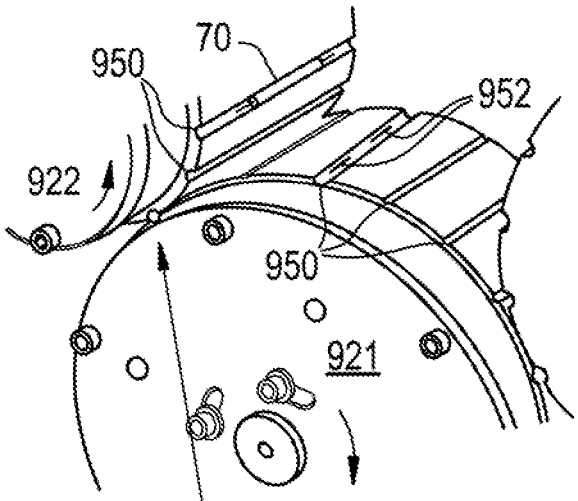

FIGS. 9*a* and 9*b* depict rotating drum transport and drum-to-drum transfer systems and methods that may be used with aspects of automated assembly of electronic vaping devices in accordance herewith. Aspects shown in FIGS. 9*a-b* may be used in the handling and transporting of cartridge units 70 during and between steps described with respect to FIG. 6, for example. As shown in FIG. 9*a*, a procession of units 70 (shown individually as solid circles) may be carried by a plurality of rotating drums 920-924 to workstations 926, 927 where manufacturing/assembly processes are performed on the cartridge units 70. In aspects, the workstations 926, 927 may correspond to any of steps 300, 400, 500, among others. In but one example, workstation 926 may include machinery configured to insert a respective downstream gasket into each of the cartridge units 70, and workstation 927 may include machinery configured to insert a respective mouth end insert into each of the cartridge units 70. Although only two workstations 926, 927 are shown for simplicity, it is understood that rotating drums similar to drums 920-924 may be used to carry cartridge units 70 to other workstations during the automated manufacture of electronic vaping devices.

In example embodiments, each drum 920-924 may include a cylindrical body with a plurality of grooves (also called flutes) spaced apart on its roll face. Each flute may be structured and arranged to hold and carry a section of an electronic vaping device, such as a cartridge unit 70.

Still referring to FIG. 9*a*, each drum 20-24 may include a rotatable fluted drum portion and a fixed internal vacuum plenum. The vacuum system selectively applies a vacuum to vacuum ports in the flutes of the rotatable drum portion as the latter rotates over the angular extent of the respective vacuum plenum. The communicated vacuum assists in holding the cartridge units 70 in the flutes during rotation of the drum. For example, the system may be adapted such that during rotation of the drums 20-24, flutes that are located in shaded areas 930 are communicated with a vacuum, while flutes that are located in unshaded areas 931 are not communicated with a vacuum. Specifically, a particular flute on counterclockwise rotating drum 920 is communicated with a vacuum when the flute is moving through the shaded area 930, and is not communicated with a vacuum when the flute is moving through the unshaded area 931. Vacuum is communicated to each flute on each drum individually, such as via a vacuum port in each flute and a vacuum source internal to the drum that selectively applies a vacuum force to the vacuum port in a particular flute based on the angular position of the particular flute along the rotational path of the roll face of the drum.

Rails 932 may also be provided adjacent to one or more of the drums 920-924 to assist in retaining the cartridge units 70 in the flutes. Further, cleaning air jets may be communicated to the port(s) of each flute at angular positions such as that indicated by area 933. The cleaning air may be selectively applied to each flute individually.

Referring now also to FIG. 9*b*, in aspects, when transferring a cartridge unit 70 from a donating flute of a first drum 921 to a receiving flute of a second drum 922, communication of vacuum is interrupted at the donating flute when the donating flute is at a location prior to the nip 935 between the first drum and the second drum. A vacuum is communicated to the receiving flute when the receiving flute is at a location prior to the nip 935 between the first drum 921 and the second drum 922. This coordination of the timing of the respective vacuum forces applied at the donating flute and the receiving flute is depicted by shaded areas 930 and unshaded areas 931 in FIG. 9*a* and facilitates moving the cartridge unit 70 out of the donating flute and into the receiving flute.

With continued reference to FIG. 9*a*, the system may include a controller "C" that is operatively connected to one or more elements. As described herein, the controller "C" may be a computer-based controller that employs hardware and software to perform automated control processes. For example, the controller "C" may be operatively connected to one or more detectors 940 for the purpose of inspecting and/or tracking cartridge units 70 during the automated manufacturing. The detectors 940 may comprise cameras or other optical detecting mechanisms that detect optical characteristics and/or information of the cartridge units 70 and transmit the detected optical characteristics and/or information to the controller "C".

For inspection purposes, the controller "C" may determine whether a cartridge unit 70 is out of specification, e.g., not properly assembled, damaged, etc., by comparing the detected optical characteristics to predefined optical criteria. Any cartridge unit 70 that is determined to be out of specification based on the detecting may be ejected from one of the rotating drums, e.g., by applying a jet of air to the flute and/or by interrupting or disabling the vacuum at the flute, e.g., as indicated at location 941, to eject the cartridge unit 70 from the respective flute. It is envisioned that an inspection station may be located downstream of the ejection station 941 to confirm proper operation of the ejection station 941. The controller "C" is programmed to track any empty flute position resulting from an ejection, and to track the empty flute position through the system (e.g., the entire system or to the next downstream workstation).

Alternatively or in addition, for tracking purposes, each cartridge unit 70 may be encoded with information such as date of manufacture, unique tracking identification, authentication, lot number, facility identification, and model number. More specifically, the individual cartridge units 70 may be printed with indicia that provide such information. The detectors 940 may include a device, such as a camera or bar code reader, which reads the encoded information on each of the cartridge units as the cartridge units are moved by the drums 920-924. The controller "C" may be programmed to track the position of each cartridge unit 70 in the system based on the encoded information detected by the detectors 940.

As depicted in FIG. 9*a*, the controller "C" may also be operatively connected to the drums 920-924, for example, to control the rotational speed of each drum. The controller "C" may also be operatively connected to the workstations 926, 927, for example, to control aspects of the automated processes that are performed at the stations.

FIG. 9*b* shows aspects of the flutes and drums as described herein. In example embodiments, the flutes 950 that receive and carry the cartridge units 70 are embodied as grooves or channels at the outer surface (e.g., roll face) of the rotating drums (e.g., drums 920-924). As shown in FIG. 9*b*, in aspects herein, the longitudinal axis of the cartridge unit 70 is transverse to the direction of rotation of the drum when the cartridge unit 70 is seated in the flute 950. Each flute 950 may include at least one port 952 that is in communication with a vacuum/pressure source of the drum. Depending on the angular location of the flute 950 along the rotational path of the drum, the vacuum/pressure source of the drum may selectively apply a vacuum, an air jet, or no force at the port 952, e.g., as described with respect to areas 930, 931, and 933 of FIG. 9*a*.

Figure 9C:
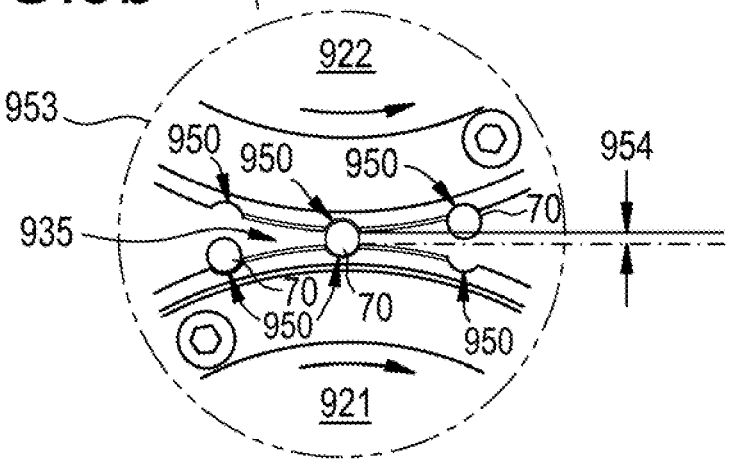
Figure 9C:
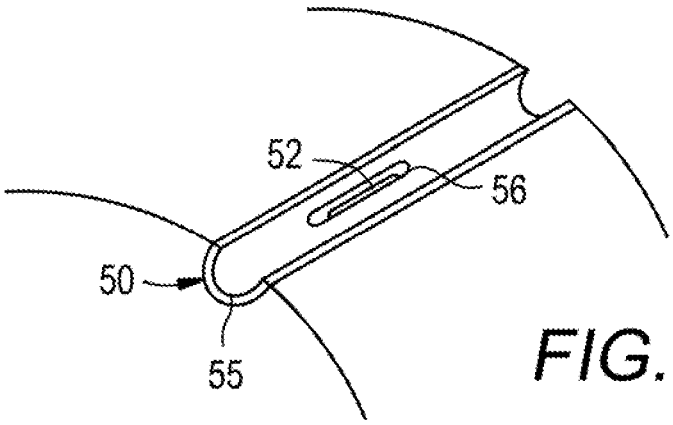

As shown in the magnified portion 953 of FIG. 9*b*, in example embodiments there is a clearance 954 between the roll surfaces of the respective drums (e.g., drums 920 and 921) at the nip 935 between the drums. For example, when the cartridge unit 70 has an outside diameter of about 7.8 mm, the clearance 954 may be about 0.5 mm to about 1 mm, although any suitable dimension of clearance may be used. As shown in FIG. 9*c*, the surface of each flute 50 may be coated or covered with a resilient (e.g., yieldable) material 55. An opening 56 in the resilient material 55 aligns with the port 52 such that vacuum or an air jet may be applied to the flute via the port 52 and opening 56. The resilient material 55 may be applied to surfaces of the drum outside of the flutes 50, for example, over the entire roll face of the drum. In another embodiment, the entire drum (e.g., the rotatable drum portions of the drums 20-24) may be constructed of the resilient material 55. In another embodiment, the resilient material 55 is provided over less than the entire flute 50; for example, a seat of resilient material may be provided in a sub-section of a flute. Such a resilient material 55 may be used with any type of drum based on the system requirements, including but not limited to a wrapping drum, MR drum, roll hand, etc.

The resilient material 55 facilitates handling the cartridge units 70 during the speeds that are involved with the rotating drums during the automated manufacture of electronic vaping devices 60 as described herein. In particular, the yieldable nature of the resilient material 55 promotes a more complete seal of the cartridge unit 70 at the vacuum port in a flute, which enhances the vacuum retention force applied to the cartridge unit 70 in the flute. The enhanced retention force maintains retention and facilitates (assures) drum to drum transfer even at higher drum speeds and with bigger and/or heavier versions of the cartridge unit 70. The above-discussed use of the resilient material may be referred to as a "soft drum" approach. Furthermore, although the resilient material has been disclosed in connection with e-vapor devices, it should be understood that the "soft drum" approach may be used in connection with other comparable and suitable objects (e.g., rigid cylindrical articles).

FIGS. 10*a* and 10*b* show aspects of a filling workstation system for performing step 300, which includes dispensing a liquid into a leading set the cartridge units in the moving procession. In example embodiments, the system is arranged such that rotation of the fluted drum 230 moves an empty flute past (and under) the outlet of the accumulator 225. Gravity pulls a cartridge unit at the outlet of the accumulator into the empty flute. Vacuum may also be selectively applied to the flute to assist in pulling the cartridge unit from the accumulator 225 into an approaching empty flute. As the fluted drum 230 continues to rotate, the trailing wall of the flute strips the cartridge unit from the outlet of the accumulator 225. Vacuum may be selectively applied via a stationary internal plenum to the flute to maintain the cartridge unit in the flute until rotation of the drum 230 brings the cartridge unit to the next rotating fluted mitre drum 232.

In accordance with aspects described herein, fluted drum 232 is a mitre drum that has a fluted outer surface angled at about 45° relative to an axis of rotation of the drum 232. Mitre drum 232 receives the cartridge units from drum 230 and provides the cartridge units to drum 234. The 45° angle of the outer fluted surface of the mitre drum 232 transitions the cartridge unit from a horizontal orientation on drum 230 to a vertical orientation on drum 234. In the vertical orientation, each cartridge unit has its open end facing upward. In aspects, the mitre drum 232, conveyor 220, and bowl feeder 215 are structured and arranged relative to one another to achieve the vertical orientation of the cartridge units at this location in the system. Each flute of mitre drum 232 and drum 234 may have at least one aperture that is configured to selectively communicate a vacuum force to a cartridge unit seated in the respective flute.

Transfer of cartridge units from drum 230 to mitre drum 232, and from mitre drum 232 to drum 234, may be performed using vacuum assisted drum-to-drum transfer in the manner described with respect to FIGS. 9*a* and 9*b*. For example, drum 230 and mitre drum 232 may be controlled to rotate in opposite directions relative to one another. As the rotation of drum 230 brings a cartridge unit held in a flute on drum 230 toward the mitre drum 232, the vacuum may be discontinued on the flute of drum 230 and a vacuum may be applied to a receiving flute on mitre drum 232. In this manner, the cartridge unit may be transferred from a flute on the drum 230 to a flute on the mitre drum 232. A similar drum-to-drum transfer may take place between mitre drum 232 and drum 234, with mitre drum 232 and drum 234 rotating in opposite directions relative to one another.

With continued reference to FIGS. 9 and 10*a-b*, the system includes a fluted rotating drum 236 that is arranged to receive cartridge units from the fluted rotating drum 234, with the drum 234 and the drum 236 rotating in opposite directions relative to one another. In example embodiments, a first (retention) belt 240 wraps around a central portion of the drum 236 and moves with the drum 236, as described in greater detail below. Vacuum apertures in the flutes of the drum 236 are positioned above and/or below a groove that receives the first belt 240. The first belt 240 is arranged in a groove in the drum 236 such that the first belt 240 is between (i) the central body of the drum 236 and (ii) cartridge units held in flutes of the drum 236.

Figure 13:
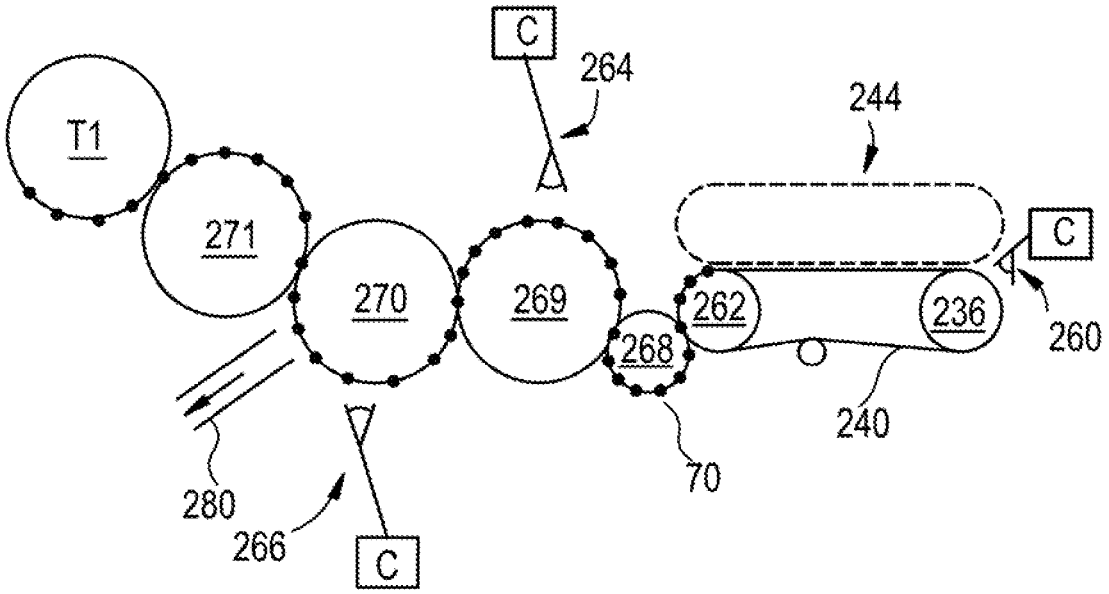
FIGS. 13-16 show additional aspects of a system for performing automated processing steps in accordance with an example embodiment.

As depicted in FIGS. 10*a-b* and FIG. 13, the drum 236 transfers cartridge units from the drum 234 onto an endless, fluted belt 244 in procession. In example embodiments, the endless belt 244 has flutes, each of which is configured to hold one of the cartridge units. As used herein, a fluted belt may comprise a pocketed belt or a pleated belt. The endless belt 244 may also have an associated lower shelf upon which the bottommost surface of each of the cartridge units sits. The bottom shelf maintains all the cartridge units on the endless belt 244 at a uniform height, which facilitates the filling operation as described in greater detail herein. The endless belt 244 may also include an upper shelf arranged over the uppermost surface of each of the cartridge units. The upper shelf prevents the cartridge units arranged in the endless belt 244 from moving upward out of the flute on the endless belt 244. The first belt 240 extends in an opposing relation along a portion of endless belt 244 and biases the cartridge units against the flutes on the endless belt 244. In this manner, cartridge units that are in flutes on the endless belt 244 are constrained in the horizontal direction by the flute surface and belt 240, and in the vertical direction by the upper and lower shelves.

In additional aspects, an inclined ramp may be provided at the beginning or upstream of the endless belt 244. The inclined ramp may be arranged below the cartridge units and extends, in the direction of travel of the cartridge units, from a position lower than the lower shelf to a position on level with the lower shelf. In this manner, any cartridge units that are lower than the lower shelf, e.g., when on drum 236, are moved upward to a position on level with the lower shelf. A second inclined ramp may be provided to urge cartridge units 70 into proper position relative to the upper shelf of the filling workstation.

In example embodiments, the filling workstation includes a carriage 246 that carries a plurality of filler units 248. The carriage 246 is located over a portion of the endless belt 244 such that the filler units 248 may be substantially vertically aligned with respective cartridges units as they are carried upon the flutes of the endless belt 244. The carriage 246 is selectively movable in the same horizontal direction as the endless belt 244, and is controlled to move horizontally at a same rate as the endless belt 244 so as to maintain each filler unit 248 in its substantial vertical alignment with a respective one of the respective cartridges 70 units carried by a flute of the endless belt 244. The carriage 246 is also selectively moveable in a vertical direction for inserting the respective needles 250 of the filler units 248 into the cartridges units carried by flutes of the endless belt 244, and for subsequently moving the respective needles (syringes) 250 of the filler units 248 vertically out of the cartridge units after completing the filling process. During filling, the needle 250 and the filler unit 248 move with the respective cartridge 246 unit along the path defined by the endless belt 244. Upon completion of a filling operation by one or more respective filler units 248, the needle 250 is fully retracted from the cartridge unit with clearance and the carriage 246 is returned to its original upstream location above the belt 244. All filler units of the carriage 246 may act in unison (simultaneously) during the filling operation.

Using the selective horizontal and vertical movement of the carriage 246 as described above, inserting liquid into the cartridge units on endless belt 244 may be performed as follows: the carriage 246 moves horizontally at a same rate as the endless belt 244, thus keeping the filler units 248 aligned with respective cartridge units held on the endless belt 244; as the carriage 246 and endless belt 244 are moving horizontally, the carriage 246 also moves vertically downward to insert the filler units 248 into respective ones of the cartridge units; fluid is discharged into the cartridge units via the filler units 248 while the filler units 248 are inside the cartridge units; after filling with fluid, the carriage 246 moves upward to remove the filler units 248 from the cartridge units; the carriage 246 moves horizontally in a direction opposite the endless belt 244 to align the filler units 248 with a next set of cartridge units in the vertical procession of cartridge units; and the process repeats with the next leading set of cartridge units in the vertical procession.

Figure 11A:
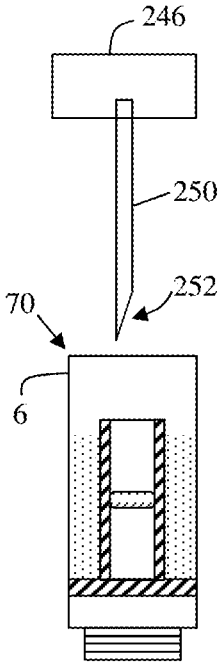
FIGS. 11*a-f* and FIGS. 12*a-d* depict details of methods of inserting liquid into the cartridge units in accordance with an example embodiment.
Figure 11B:
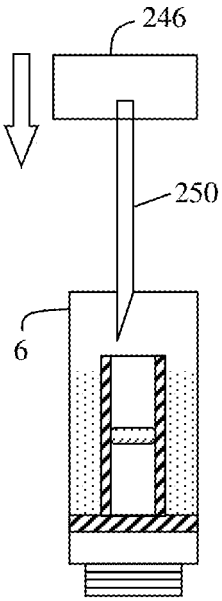
Figure 11C:
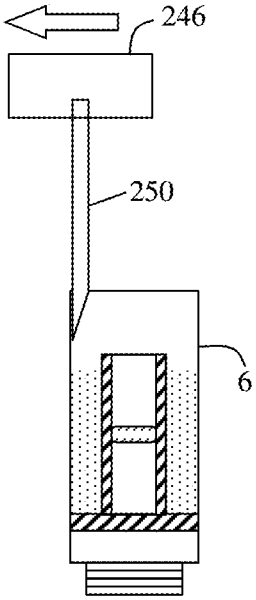
Figure 11D:
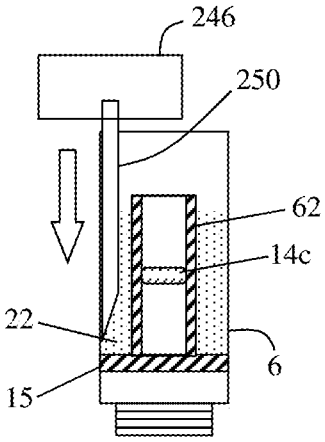

FIGS. 11*a-f* depict details of a method of inserting liquid into the cartridge units using the filler units 248. As described herein, filling a cartridge unit with liquid refers to adding a predefined amount of liquid to the liquid reservoir 22. In example embodiments, each of the filler units 248 comprises a hollow needle (syringe) 250 having an angled end 252. As depicted in FIG. 11*a*, the carriage 246 initially substantially aligns the needle 250 with a center of the outer tube 6 of a cartridge unit 70 that is held in a flute on the endless belt 244. As shown in FIG. 11*b*, the carriage 246 lowers the needle 250 into an upper portion of the outer tube 6 while in the centered position. As shown in FIG. 11*c*, the carriage 246 moves the needle 250 in proximity or into contact with an inside surface of the outer tube 6. As shown in FIG. 11*d*, the carriage 246 moves the needle 250 downward to a first filling position into a space between the outer tube 6 and the inner tube 62, i.e., in the liquid reservoir 22. In example embodiments, the outlet of the end 252 of the needle 250 in the first filling position is lower than the heater 14 and about 1 mm to 2 mm above the upstream gasket 15. While the needle 250 is in the first filling position, a pump associated with the needle 250 is controlled to pump a first predetermined amount of liquid through the hollow needle 250 into the liquid reservoir 22. The first predetermined amount may be optimized to avoid overflow.

Figure 11E:
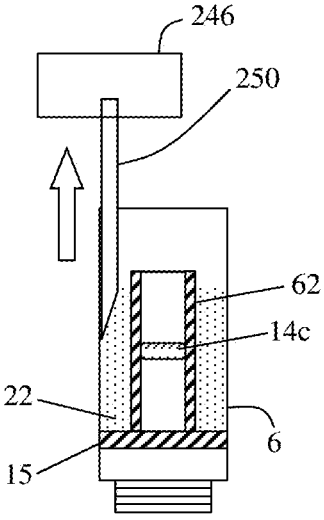

As depicted in FIG. 11*e*, the carriage 246 moves the needle 250 upward to a second filling position in the space between the outer tube 6 and the inner tube 62. In example embodiments, the outlet of the needle 250 in the second filling position is lower than the top of the inner tube 62 and higher than the heater 14. While the needle 250 is in the second filling position, a pump associated with the needle 250 is controlled to pump a second predetermined amount of liquid through the hollow needle 250 into the liquid reservoir 22. In example embodiments, the first amount of liquid and the second amount of fluid are each about 50% of the predefined grand-total amount of liquid to be provided to the liquid reservoir 22, although other ratios may be used. By dividing the filling operation into two or more filling steps, the possibility of overflowing the liquid reservoir 22 is abated if not wholly avoided.

Figure 11F:
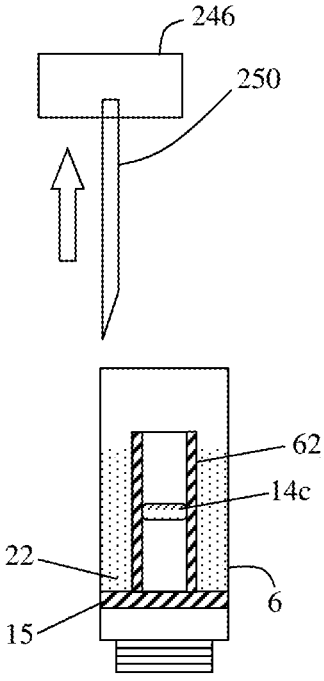

As depicted in FIG. 11*f*, the carriage 246 moves the needle 250 upward out of the outer tube 6 after the first and second filling steps. The movement of the carriage 246 and needle 250 depicted in FIG. 11*a-f* occurs while the cartridge unit is continuously moving horizontally due to the movement of the endless belt 244. The movement of the carriage 246 and the movement of the endless belt 244 are controlled and coordinated relative to one another by a computer controller "C" and precision motors and/or actuators. Upon retraction of the needle 250 with clearance of the respective cartridge unit, the carriage 246 is returned to its original position. In example embodiments, a purge step of the needle 250 (with air) may optionally be performed during the return stroke of the carriage to the original position.

As shown in FIG. 11*a-f*, the needle 250 may have an angled end 252. In example embodiments, the longer end of the angled end 252 is arranged to be closer to the inside wall of the outer tube 6, and the shorter end of the angled end is arranged to be closer to the inner tube 62 when the needle 250 is moved downward into the cartridge unit. In this manner, the likelihood of snagging the needle on the material of the liquid storage medium 210, e.g., gauze, etc., is minimized.

The carriage 246 may be configured to carry any desired number of filler units 248. In an example arrangement, the carriage 246 carries sixteen filler units 248. In this manner, sixteen leading cartridge units held on the endless belt 244 may simultaneously undergo the filling process depicted in FIG. 11*a-f*. Any desired number of pumps may be used with the number of filler units 248. For example, one pump may provide fluid to all the filler units 248. In another example, each filler unit 248 may be connected to its own dedicated pump. In an example arrangement, eight pumps are used with sixteen filler units 248, such that one pump provides fluid to two filler units 248. Any suitable pumps may be used. In an implementation, the pumps are precision positive displacement pumps. Each pump may be driven by an electric motor that is controlled by the controller "C". The pumps may be connected to the respective filler units 248 using appropriate plumbing. The pumps may also be connected to a liquid supply, e.g., reservoir, by appropriate plumbing.

Figure 12A:
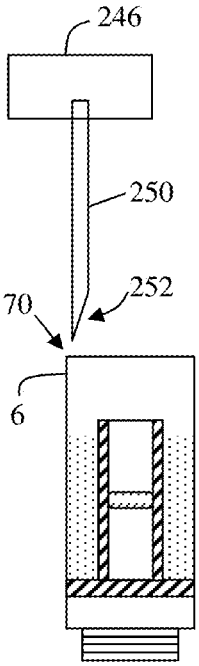
Figure 12B:
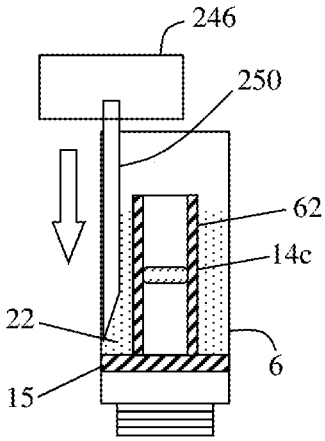
Figure 12C:
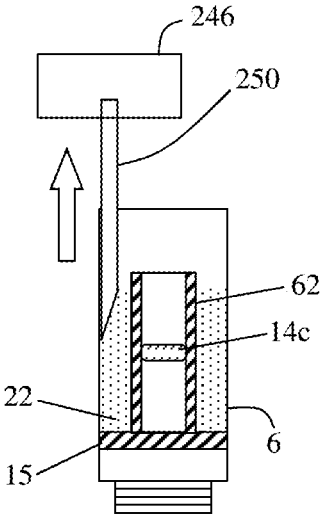
Figure 12D:
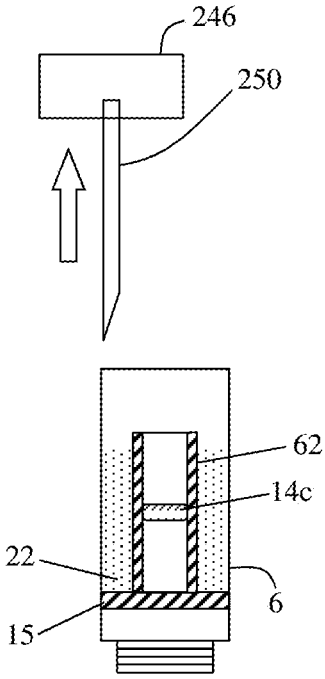

FIGS. 12*a-d* depict details of another method of inserting liquid into the cartridge units using the filler units 248. As depicted in FIG. 12*a*, in this embodiment the carriage 246 moves the needle 250 to a first position over a cartridge unit 70 that is held in a flute on the endless belt 244. As shown in FIG. 12*b*, the carriage 246 moves the needle 250 downward to a second position into a space between the outer tube 6 and the inner tube 62, i.e., in the liquid reservoir 22. The first position and the second position are vertically aligned with each other relative to the cartridge unit 70, such that moving the needle 250 from the first position to the second position comprises moving the needle 250 vertically relative to the cartridge unit 70. In example embodiments, the second position is such that the needle 250 is closer to the outer tube 6 than the inner tube 62 (e.g., such that the needle 250 is about 0.5 mil to about 1.5 mil away from the outer tube 6). As shown in FIG. 12*c*, the carriage 246 moves the needle 250 vertically upward relative to the cartridge unit 70 to a third position at which the lower end of the needle is still inside the cartridge unit 70. As shown in FIG. 12*d*, the carriage 246 moves the needle 250 vertically upward relative to the cartridge unit 70 to a fourth position in which the needle 250 is entirely outside the cartridge unit 70. After the sequence of movements depicted at FIGS. 12*a-d*, the carriage 246 moves to a beginning position (e.g., as in FIG. 12*a*) over another cartridge unit 70 in the procession of cartridge units, and the process repeats. The embodiment of FIGS. 12*a-d* better utilizes the limited cycle time available for filling.

In the example embodiment of FIGS. 12*a-d*, fluid may be pumped through the needle 250 into the liquid reservoir 22 at least one of the following times: while the needle 250 is moving from the first position to the second position; while the needle 250 is stopped at the second position; while the needle 250 is moving from the second position to the third position; and while the needle 250 is stopped at the third position. The flow rate of the liquid through the needle may be controlled and selectively varied using a pump that is controlled by the controller "C". The speed of movement of the needle 250 may also be controlled and selectively varied using an actuator that moves the carriage 246 that is controlled by the controller "C".

In a particular embodiment, the flow rate of the liquid and the speed of movement of the needle 250 are both varied as the needle 250 is moving from the second position to the third position. The selectively varying the flow rate of the liquid and the speed of movement of the needle 250 may be optimized to tune the filling of the liquid reservoir 22 to achieve the goal of filling in a shortest amount of time without spilling. The flow rate of the liquid being pumped through the needle 250 may be precisely controlled using, for example, a syringe pump that is actuated using a servo linear actuator. In example embodiments, each one of a set of needles 250 is fluidly connected to a respective one of a set of syringe pumps, and a single actuator pushes a bar that simultaneously moves all the plungers of all of the pumps of the set. In this manner, a plurality of cartridge units 70 may be filled simultaneously. The set may be of any desired number, including two, four, eight, etc. Alternatively, each one of the set of syringe pumps may be independently controlled with its own respective actuator, which also provides for simultaneous filling of plural cartridge units 70

Referring now to FIGS. 10*a* and 13, a detector 260 may be arranged upstream of the endless belt 244. However, it should be understood that there are alternative locations for the detector 260. In example embodiments, the detector 260 is configured to detect a condition of a cartridge unit at a flute of the endless belt 244 that triggers disabling the filler unit 248 associated with that particular flute. For example a cartridge unit may be missing from a flute in the endless belt, or a cartridge unit may be in the flute but damaged or improperly oriented, e.g., upside down. In such events, it is desirable to avoid dispensing liquid to the flute location since doing so would create a spill. Accordingly, a controller "C" connected to the detector 260 tracks the location of a flute of the endless belt 244 with such a condition and disables the pump associated with the filler unit 248 for that particular flute for this particular fill iteration. The controller "C" may re-activate the pump and filler for the next fill iteration in the event the detector detects a normal cartridge unit in the flute. The detector may be a camera or other optical detector that passes images to the controller "C" for determining whether a particular flute of the endless belt meets pre-defined no-fill criteria, e.g., missing cartridge unit, improperly oriented cartridge unit, out of specification cartridge unit, etc. This temporary disabling of a filler unit 248 based on detecting a missing or upside down cartridge unit may be implemented with both embodiments shown in FIGS. 11*a-f* and FIGS. 12*a-d*. In an implementation where a plurality of filler units 248 are actuated together, the entire plurality may be temporarily disabled based on detecting a single missing or upside down cartridge unit.

In example embodiments, the system includes an ejection mechanism that ejects a cartridge unit from a flute prior to the filling workstation based on detecting that the cartridge unit in the flute is damaged or improperly oriented. The detecting may be by detector 260 and the ejecting may be controlled by controller "C" based on a signal received from detector.

In example embodiments, a fill station accumulator may be arranged upstream of the filling workstation and downstream of a location where damaged or improperly oriented cartridge units are ejected. The fill station accumulator may be arranged to feed cartridge units onto flutes of the drum 236. By accumulating cartridge units prior to the filling workstation, the fill station accumulator may reduce the number of instances of empty flutes at the filling workstation, which in turn reduces the number of times one or more of the filler units 248 are temporarily disabled as described herein.

Referring to FIGS. 10*a-b* and 13, after filling the cartridge units at the filling workstation, the cartridge units are transferred from the endless belt 244 to a fluted rotating drum 262. Belt 240 wraps around a central portion of drum 262, thus forming an endless circuit around drums 236 and 262. In example embodiments, the rotation of drums 236 and 262 may be controlled such that the belt 240 moves at a same rate as the endless belt 244 at the locations where the belt 240 holds cartridge units in the flutes of the endless belt 244. As with drum 236, drum 262 is configured such that the cartridge units are outside of the belt 240 when seated in the flutes of drum 262. Portions of the flute surfaces of drums 236 and 238 that are not covered by the belt 240 may be provided with vacuum ports for selectively applying vacuum to the retain cartridge units in the flutes along the arcuate (circumferential) extent that the cartridge units are to be retained upon the drum 262.

FIG. 13 shows a diagrammatic plan view of elements of the system downstream of the filling workstation. As depicted in FIG. 13, the system may include a number of fluted drums 268-271 between the drum 262 and a turret T1 where the processes of stage 4 are executed. In example embodiments, the drums 268-271 operate using rotating drum transport principles as described with respect to FIGS. 9*a* and 9*b*. For example, each of the drums 268-271 is a rotating drum with a fluted outer surface with each of the flutes being sized to receive and retain a cartridge unit therein. Each flute of drums 268-271 may also contain at least one (e.g., at least two) aperture for selectively applying vacuum force at the flute, i.e., to retain a cartridge unit in the flute and to accomplish drum-to-drum transfer of cartridge units. In aspects, the drums 268-271 are structured and arranged to provide drum-to-drum transfer of the cartridge units 70 (shown as dots on the drums) while maintaining the vertical orientation of the procession of cartridge units so liquid is not spilled.

In example embodiments, at least one of drums 269-271 may be provided with a pitch between flutes that is different than the pitch between flutes of the immediately preceding drum. Pitch in this sense may be defined as a circumferential distance between adjacent flutes. The difference in pitch between the two drums may be used to adjust the spacing of the cartridge units in the procession to match a spacing between flutes of drums used in workstations of downstream assembly operation, such as the turret T1. In an implementation, the drum 268 has a pitch of about 12.7 and drum 269 has a pitch of about 20.0. In this manner, the spacing between cartridge units in the procession is altered between stage 3 and stage 4.

Still referring to FIG. 13, one or more detectors may be provided for detecting cartridge units that may be out of specification after the filling workstation. For example, a first detector 264 may be configured to detect cartridge units that have not been filled with any liquid, and a second detector 266 may be provided to detect cartridge units that are overfilled and/or leaking liquid. The detectors 264, 266 may comprise cameras or other optical detecting mechanisms that detect optical characteristics of the cartridge units and transmit the detected optical characteristics to a controller "C". In turn, the controller "C" may determine whether a cartridge unit is out of specification, e.g., not filled, leaking, etc., by comparing the detected optical characteristics to predefined optical criteria. Any cartridge unit that is determined to be out of specification based on the detecting may be ejected from one of the rotating drums, e.g., by application of a jet of air and/or by interrupting or disabling the vacuum at the flute when the flute reaches an ejection/rejection station to remove the cartridge unit so as to drop the cartridge unit from the flute into a reject chute 280.

Figure 16:
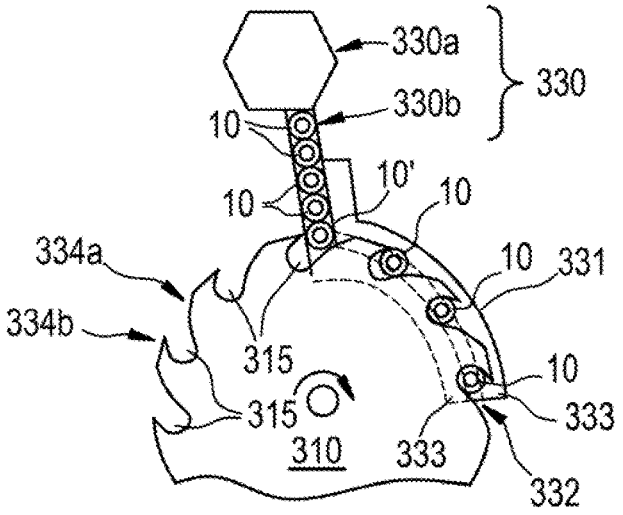
Figure 14:
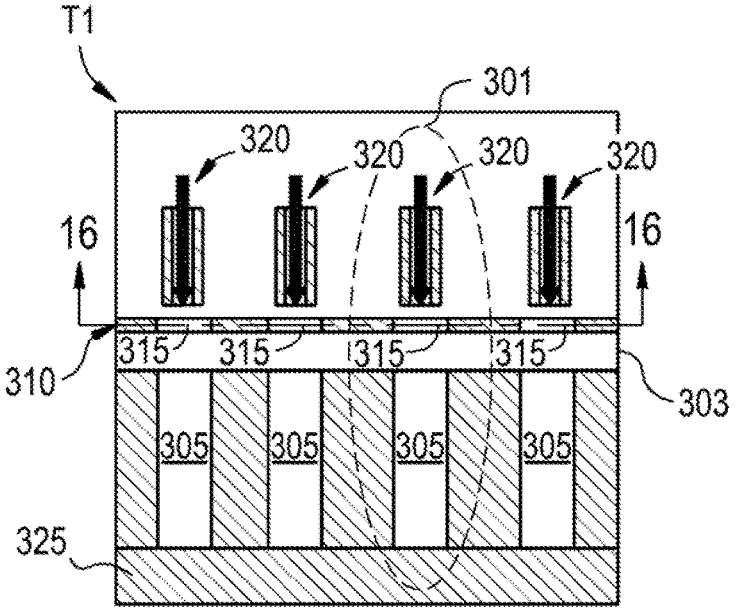
Figure 15:
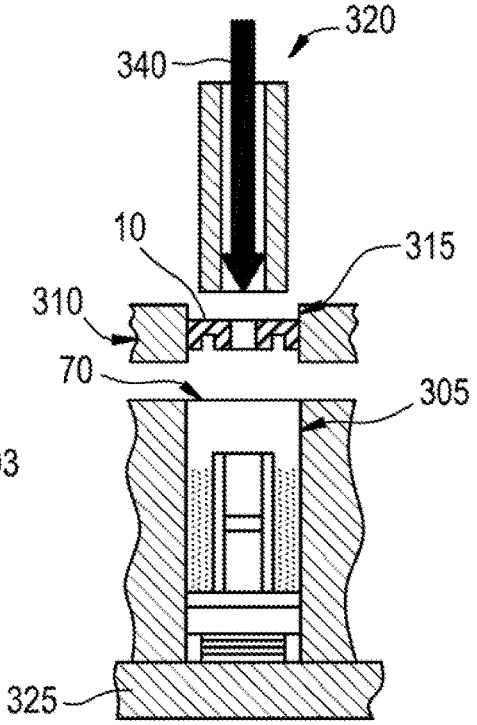

FIGS. 14-16 show aspects of a turret T1 in accordance herewith. In example embodiments, turret T1 is used in association with step 400 at a sealing workstation. FIG. 14 is a diagrammatic side view of the turret T1, FIG. 15 is a detailed diagrammatic side view of section 301 of FIG. 14, and FIG. 16 is a plan (top) view of a section of the turret T1 along line 16-16 in FIG. 14.

Referring now to FIG. 14, the turret T1 includes a rotating drum-like structure 303 having a plurality of flutes 305. Each flute 305 is sized to receive a single cartridge unit 70 and includes vacuum ports for retaining a cartridge unit in the respective flute. Referring now also to FIG. 16, the turret T1 also includes a pocket wheel 310 having a plurality of pockets 315. Each pocket 315 is vertically aligned with and over one of the flutes 305, and is sized to receive and temporarily carry a downstream gasket 10 received from a source 330. The turret T1 also includes a plurality of inserters 320, each of which is vertically aligned and over one of the pockets 315 and one of the flutes 305. The pocket wheel 310, inserters 320, and flutes 305 all rotate with the turret T1 at a same rate relative to one another such that respective ones of these elements remain vertically aligned with one another during rotation of the turret T1.

The source 330 may include an accumulated procession of downstream gaskets 10 that is provided by a feeder, such as a vibratory bowl feeder 330*a* or the like. In example embodiments, the vibratory bowl feeder 330*a* orients the gaskets 10 in a proper vertical orientation and releases the gaskets 10 in this orientation onto a conveyor 330*b* for pick-up by the pocket wheel 315. The source 330 may be structured and arranged such that the continuous movement of the conveyor 330*b* underneath the procession of downstream gaskets 10 provides a force on the leading gasket 10' in the procession, which force urges the leading gasket 10' into the next pocket 315 of the pocket wheel 310 as the pocket wheel 310 rotates past the source 330. In example embodiments, each pocket 315 has a tapered leading edge 334*a* to facilitate smooth entry of a downstream gasket 10 from the source 330, and a trailing edge 334*b* configured to strip the downstream gasket 10 from the source 330. A plow or other position adjustment mechanism may be employed to adjust a position of the downstream gasket 10 within the pocket 315, i.e., to move the downstream gasket 10 against one or more registration surfaces that align the downstream gasket 10 with the inserter 320 and the cartridge unit 70, after the pocket 315 receives the downstream gasket 10 from the source 330. The position adjustment mechanism may comprise, for example, a slide-rail. In example embodiments, a support structure 331 may extend under the pockets 315 for about a 90° arcuate extent of the pocket wheel 310. The support structure 331 includes a groove 332 sized to accommodate (e.g., provide clearance for) a lower portion of the pin 340, and its support surfaces 333 support the downstream gasket 10 from below when the pin 340 is first lowered to skewer the downstream gasket 10, e.g., as described in detail with reference to FIG. 17*a*.

In operation, during rotation of the turret T1, a pocket 315 receives a downstream gasket 10 from a source 330. After receiving the downstream gasket 10 in a particular pocket 315, the turret T1 continues to rotate and the flute 305 aligned with the pocket 315 receives a cartridge unit from the drum 271, e.g., using drum-to-drum transfer techniques. Alternatively, the turret T1 may be structured and arranged such that the flute 305 receives the cartridge unit prior to, or at the same time as, the corresponding pocket receives the downstream gasket 10. In this manner, an aligned pocket 315 and flute 305 are loaded with a downstream gasket 10 and a cartridge unit 70, respectively, as shown in FIG. 15. During continued rotation of the turret T1, the inserter 320 that is aligned with the particular pocket 315 and flute 305 moves the downstream gasket 10 into the cartridge unit 70. Subsequently, the cartridge unit 70 with the downstream gasket 10 inserted therein, is moved from the turret T1 to a flute of a next downstream drum, e.g., using drum-to-drum transfer techniques.

The turret T1 may employ vacuum to retain the cartridge unit in the flute 305. The turret T1 may also include a rim 325 at each flute 305 that prevents downward motion of the cartridge unit 70 within the flute 305 during insertion operations.

FIGS. 17*a-d* depict insertion of the downstream gasket 10 into the cartridge unit 70 using the inserter 320 in accordance with aspects described herein. In example embodiments, each inserter 320 includes a plunger 335 and a pin 340 that are moveable together and independently in a vertical direction relative to the cartridge unit 70, all in response to the controller "C". In example embodiments, the pin 340 is arranged in an axial bore of the plunger 335.

Figure 17A:
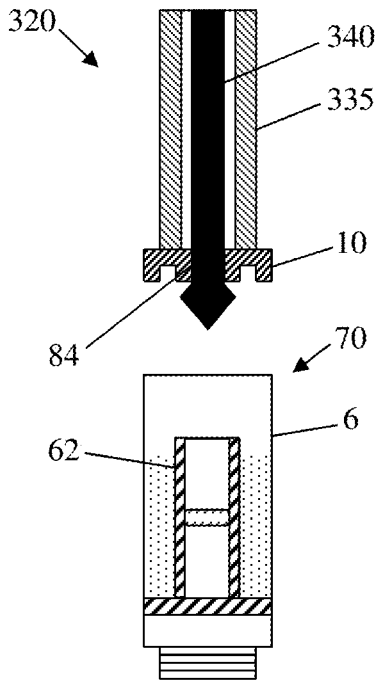
FIGS. 17*a-d* depict the insertion of a downstream gasket into a cartridge unit in accordance with an example embodiment.

As depicted in FIG. 17*a*, the plunger 335 and the pin 340 are moved vertically relative to a downstream gasket 10 contained in a pocket 315 of the pocket wheel 310. This movement brings the plunger 335 into contact with an upper surface of the downstream gasket 10 and extends a pointed tapered end portion of the pin 340 through the central channel 84 of the downstream gasket 10.

Figure 17B:
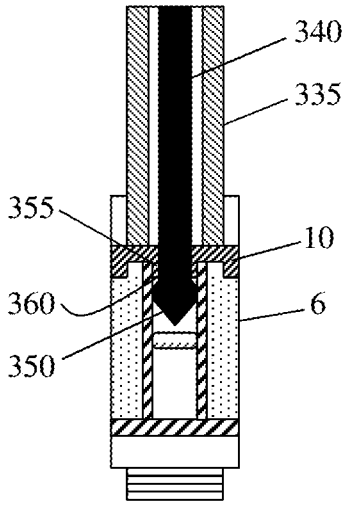

As depicted in FIG. 17*b*, the plunger 335 and the pin 340 are moved vertically downward as a unit toward the cartridge unit 70 seated and retained in the flute 305. This movement pushes the downstream gasket 10 out of the pocket 315 and into the interior of the outer tube 6 of the cartridge unit 70 that is contained in the flute 305. In aspects, a pointed and tapered end 350 of the pin 340 ensures that the pin 340 enters the interior of the inner tube 62 during the downward movement. In further aspects, a collar 355 that defines the central channel 84 is pushed into the interior of the inner tube 62. The collar 355 may have a tapered leading edge (end portion) 360 to facilitate entry into the inner tube 62 and to accommodate any canting (offset) of a chimney 62 from center.

Figure 17C:
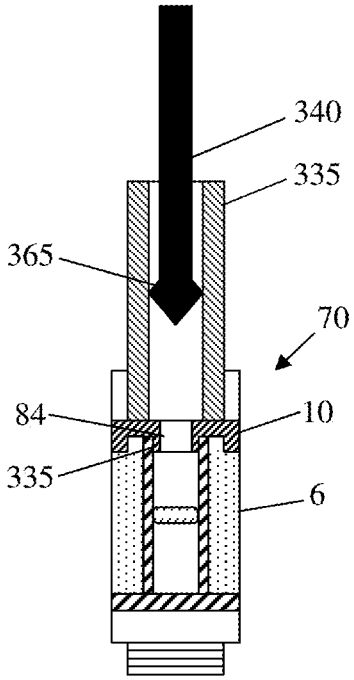

As depicted in FIG. 17*c*, the pin 340 is withdrawn by being moved vertically upward relative to the cartridge unit 70 while the plunger 335 remains stationary relative to the cartridge unit 70. In this manner, the pin 340 is retracted out of contact with the downstream gasket 10 while the plunger 335 keeps the downstream gasket 10 in the cartridge unit 70 during the pin retraction. In example embodiments, the pin 340 may be provided with a flared surface 365 that facilitates retraction of the pin 340 from the downstream gasket 10 without dislodging the downstream gasket 10 from its seated position against the inner tube 62 and without pulling the collar 355 through the central channel 84.

Figure 17D:
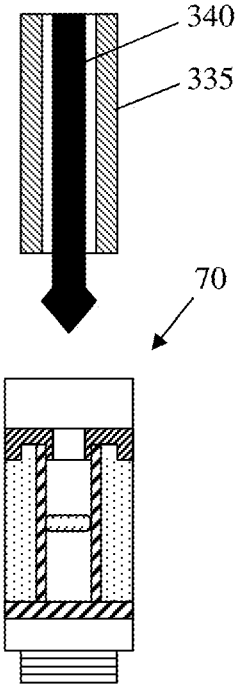

As depicted in FIG. 17*d*, once the pin has been retracted, the plunger 335 is moved vertically upward relative to the cartridge unit 70. In this manner, both the plunger 335 and the pin 340 are completely retracted from the cartridge unit 70 with clearance. Movement of the plunger 335 and the pin 340 as described herein may be controlled using a cam mechanism associated with the turret T1, or other suitable mechanism.

In example embodiments, the turret T1 and associated elements are structured and arranged such that a plurality of downstream gaskets 10 are simultaneously inserted into a respective plurality of cartridge units 70. The turret T1 is equally divided into eight sections of six inserters 320 that simultaneously insert six downstream gaskets 10 into six respective cartridge units 70; however, embodiments are not limited to this implementation and other arrangements may be employed. The movement of the elements of each one of the eight sections may be individually controlled independent of the other sections using, for examples, cam mechanisms.

Using the cartridge unit inspection and tracking systems described herein, the controller "C" may determine when a cartridge unit is not present in one of the flutes 305 of the turret T1. In this situation of a missing cartridge unit, the turret T1 may be configured to eject the downstream gasket 10 (e.g., by using an air jet and/or by interrupting or disabling the vacuum) from the particular pocket 315 aligned with the empty flute 305 prior to that pocket 315 being rotated to the conveyor 330*b*. In this manner, the downstream gasket 10 that is carried by the particular pocket 315 is ejected to avoid a second downstream gasket 10 being loaded into the same pocket 315, which could create a jam that results in machine stoppage.

Figure 18:
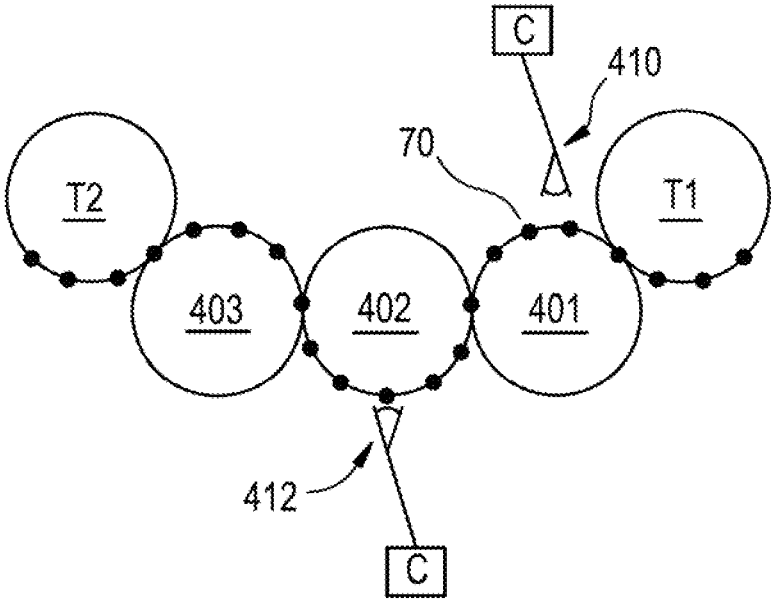

FIG. 18 shows a diagrammatic plan (top) view of transfer of elements of the system between the turret T1 and a turret T2. As depicted in FIG. 18, the system may include a number of drums 401-403 between turret T1 and turret T2. In example embodiments, the drums 401-403 operate using rotating drum transport principles as described with respect to FIGS. 9*a* and 9*b*. For example, each of the drums 401-403 is a rotating drum with a fluted outer surface with each of the flutes being sized to receive and retain a cartridge unit 70 therein. Each flute of drums 401-403 may also contain at least one (e.g., at least two) aperture for selectively applying vacuum force at the flute via a stationary vacuum plenum within the drum, i.e., to retain a cartridge unit in the flute and to accomplish drum-to-drum transfer of cartridge units. In aspects, the drums 401-403 are structured and arranged to provide drum-to-drum transfer of the cartridge units while maintaining the vertical orientation and order of the procession of cartridge units.

Still referring to FIG. 18, one or more detectors may be provided for detecting cartridge units that are out of specification after the downstream gasket insertion stage. For example, a first detector 410 may be configured to detect cartridge units in which a downstream gasket 10 is not properly inserted, and a second detector 412 may be provided to detect missing cartridge units and/or a cartridge unit having a downstream gasket 10 that has been inserted incorrectly (e.g., upside down or canted). The detectors 410, 412 may comprise cameras or other optical detecting mechanisms that detect optical characteristics of the cartridge units and transmit the detected optical characteristics to a controller "C". In turn, the controller "C" may be programmed to determine whether a cartridge unit is out of specification by comparing the detected optical characteristics to predefined optical criteria, such as by way of a "mask". Any cartridge unit that is determined to be out of specification based on the detecting may be ejected from one of the rotating drums, e.g., by applying a jet of air to the respective flute and/or by interrupting or disabling the vacuum at the flute when the flute reaches an ejection/rejection station to remove the out of specification cartridge unit from the flute and into a reject chute.

Figure 21:
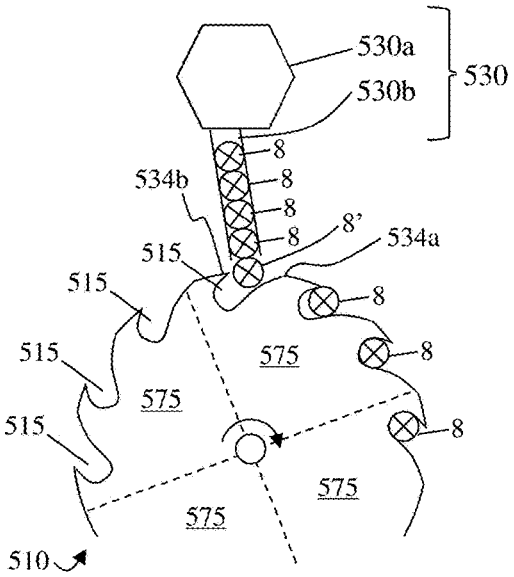
Figure 20B:
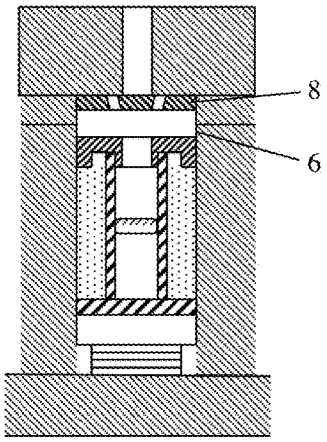
Figure 19:
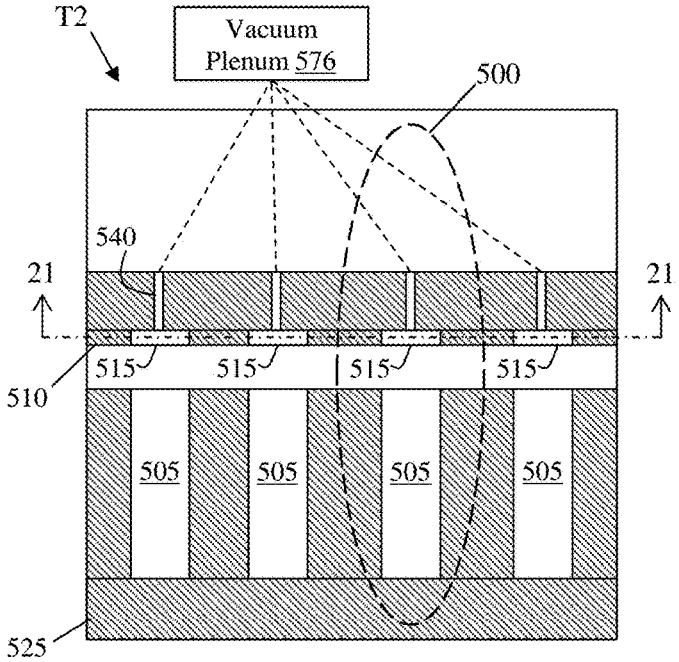
Figure 20A:
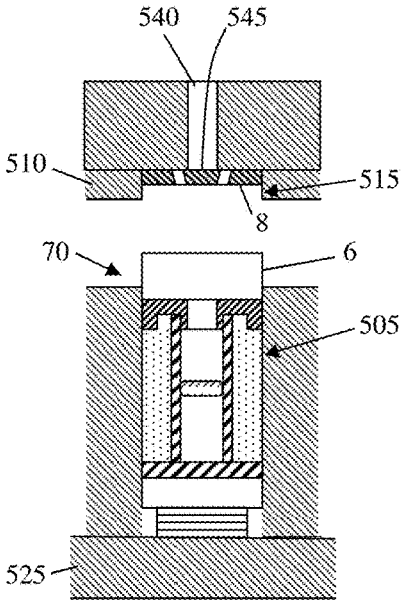

FIGS. 19-21 show aspects of a turret T2 used for inserting mouth end inserts 8 into the cartridge units in accordance herewith. In example embodiments, the turret T2 is used in association with step 500 at a mouthpiece workstation. FIG. 19 provides a diagrammatic side view of the turret T2, FIGS. 20*a* and 20*b* provide diagrammatic detail side views of section 500 of FIG. 19, and FIG. 21 provides a plan (top) view of a section of the turret T2 along line 21-21 in FIG. 19. The turret T2 includes a rotating drum-like structure having a plurality of flutes 505. Each flute 505 is sized to receive a single cartridge unit 70. The turret T2 also includes a pocket wheel 510 having a plurality of pockets 515. Each pocket 515 is vertically aligned with and over one of the flutes 505, and is sized to receive and temporarily carry a mouth end insert 8 from a source 530. The pocket wheel 510 and flutes 505 all rotate with the turret T2 at a same rate relative to one another such that respective ones of these elements remain vertically aligned with one another during rotation of the turret T2.

The source 530 may include an accumulated procession of mouth end inserts 8 that is provided by a feeder, such as a vibratory bowl feeder 530*a* or the like. In example embodiments, the vibratory bowl feeder 530*a* orients the mouth end inserts 8 in a proper vertical orientation and releases the mouth end inserts 8 in this orientation onto a conveyor 530*b* for pick-up by the pocket wheel 515. The source 530 may be structured and arranged such that the continuous movement of the conveyor 530*b* underneath the procession of mouth end inserts 8 provides a force on the leading insert 8' in the procession, which force urges the leading insert 8' into the next pocket 515 of the pocket wheel 510 as the pocket wheel 510 rotates past the source 530. In example embodiments, each pocket 515 has a tapered leading edge 534*a* to facilitate smooth entry of a leading insert 8' from the source 530, and a trailing edge 534*b* configured to strip the leading insert 8' from the source 530. A position adjustment mechanism may be employed to adjust a position of the mouth end insert 8 within the pocket 515, i.e., to move the mouth end insert 8 against one or more registration surfaces that align the mouth end insert 8 with the cartridge unit 70, after the pocket 515 receives the mouth end insert 8 from the source 530. The position adjustment mechanism may comprise, for example, a slide-rail, plow, application of a vacuum, or the like. A vacuum is applied to the mouth end insert 8 from above so as to assure retention of the mouth end insert 8 in the pocket 515 of the wheel 510 until released.

In operation, during rotation of the turret T2, a pocket 515 receives a mouth end insert 8 from the source 530. After receiving the mouth end insert 8 in a particular pocket 515, the turret T2 continues to rotate and the flute 505 aligned with the pocket 515 receives a cartridge unit from the drum 403, e.g., using drum-to-drum transfer techniques as previously described. In this manner, an aligned pocket 515 and flute 505 are loaded with a mouth end insert 8 and a cartridge unit 70, respectively. During continued rotation of the turret T2, elements of the turret T2 move the mouth end insert 8 into the aligned cartridge unit 70, e.g., as depicted at step 500 of FIG. 7. Subsequently, the cartridge unit 70 (with the mouth end insert 8 inserted therein) is transferred from the turret T2 to a flute of a next downstream drum 601 (see FIG. 22*a*), e.g., using drum-to-drum transfer techniques.

The turret T2 may employ vacuum to retain the cartridge unit 70 in the flute 505 using drum vacuum retention techniques as taught herein. The turret T2 may also include a rim 525 adjacent the bottom of each flute 505 that limits downward motion of the cartridge unit 70 along the flute 505.

In example embodiments, the pocket wheel 510 is divided into circumferential sections 575 that are separately and selectively moveable in a vertical direction relative to the flutes 505. As shown in FIG. 21, there are four sections 575 each including three pockets 515. However, the pocket wheel may be structured and arranged such that there is any desired number of sections 575, with each section having any desired number of pockets 515. For example, a section 575 of the pocket wheel 510 may include six pockets 515 that are aligned with six flutes 505. In this manner, six mouth end inserts 8 that are loaded in the six pockets 515 of that section 575 may be simultaneously inserted into six respective cartridge units 70 by moving the section of the pocket wheel 510 downward toward the cartridge units 70. Referring now to FIGS. 20*a* and 20*b*, each pocket 515 may include an upper pocket wall that bears against an upper surface of a mouth end insert 8 held in the pocket 515. In this manner, the upper pocket wall pushes the mouth end insert 8 into the interior of the outer tube 6 of a cartridge unit 70 when the section of the pocket wheel 510 is translated downward relative to the cartridge unit 70, e.g., as depicted at step 500 of FIG. 7 and FIG. 22*b*. Movement of the different sections 575 of the pocket wheel 510 as described herein may be controlled using a cam mechanism associated with the turret T2, or other suitable mechanism. In example embodiments, there are eight sections 575 each having six inserters; however, any desired number of sections 575 having any desired number of inserters may be used. The movement of the elements of each one of the eight sections 575 may be individually controlled independent of the other sections using, for examples, cam mechanisms.

Referring to FIG. 20*a*, in aspects, each pocket 515 within a section 575 includes a vacuum port 540 in the upper pocket wall that is configured to selectively draw a vacuum against a central portion 545 of a mouth end insert 8 held in the pocket 515. The vacuum force may be used to retain the mouth end insert 8 in the pocket 515 until such time as the mouth end insert 8 is to be inserted into the cartridge unit 70, whereupon the vacuum is released. The vacuum port in the upper pocket wall may be located to coincide with a central area 545 of the mouth end insert 8, as shown in FIGS. 4 and 5, that is not coincident with one of the outlet passages 24. In other embodiments, wherein the mouth end insert 8 may include a central outlet passage 24, one or more vacuum ports 540 may be directed to off-center (e.g., peripheral) portions of the mouth end insert 8. Each vacuum port 540 may be in communication with a vacuum plenum 576.

Using the cartridge unit inspection and tracking systems described herein, the controller "C" may determine when a cartridge unit is not present in one of the flutes 505 of the turret T2. In this situation of a missing cartridge unit, the turret T2 may be configured to eject the mouth end insert 8 (e.g., by using an air jet and/or by interrupting or disabling the vacuum) from the particular pocket 515 aligned with the empty flute 505 prior to that pocket 515 being rotated to the conveyor 530*b*. In this manner, the mouth end insert 8 that is carried by the particular pocket 515 is ejected to avoid a second mouth end insert 8 being loaded into the same pocket 515, which could create a jam that results in machine stoppage.

Figure 22A:
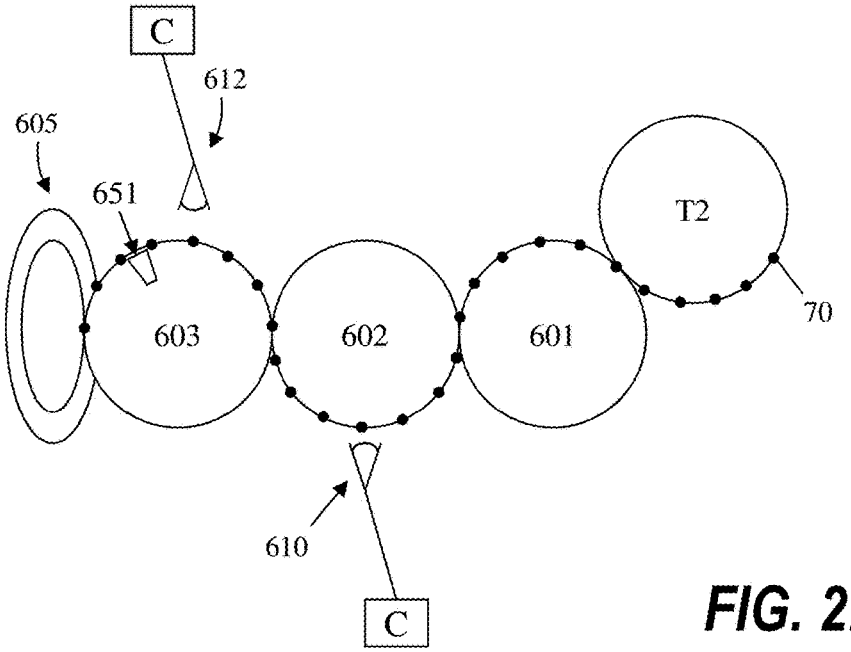
Figure 22B:
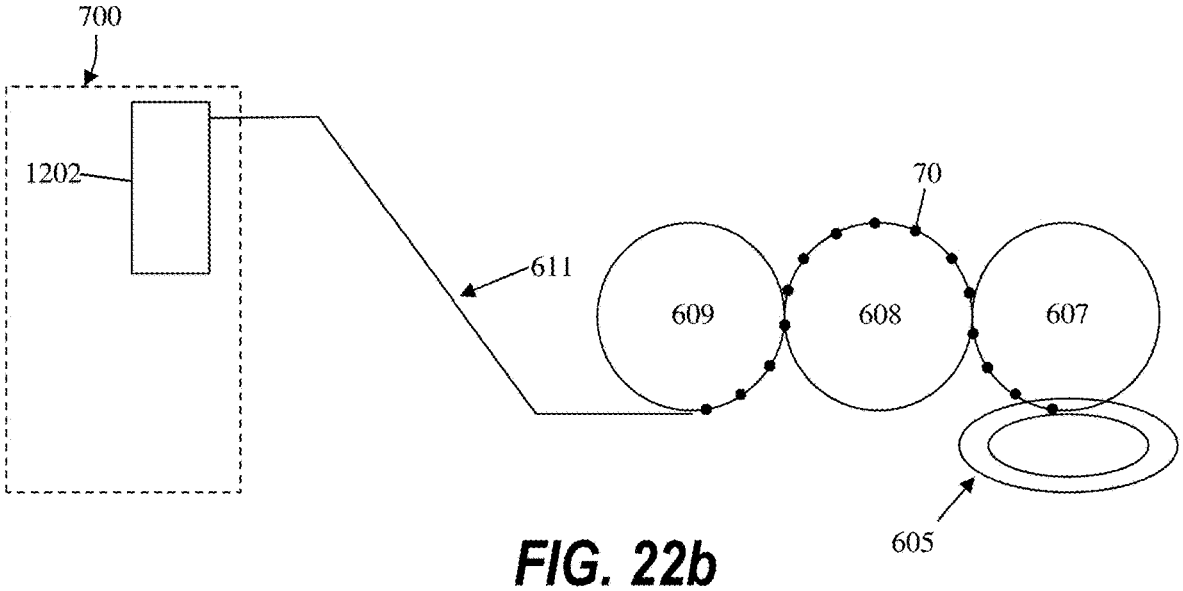

FIGS. 22*a* and 22*b* show aspects of a transfer system downstream of the turret T2. FIG. 22*a* is a top planar view of portions of the transfer system, and FIG. 22*b* is a side view (e.g., at 90° relative to the view of FIG. 22*a*) of portions of the system. As depicted in FIGS. 22*a* and 22*b*, the transfer system may include a number of fluted drums 601-603 downstream of turret T2. In example embodiments, the drums 601-603 operate using rotating drum transport principles as described with respect to FIGS. 9*a* and 9*b*. For example, each of the drums 601-603 is a rotating drum with a fluted outer surface with each of the flutes being sized to receive and retain a cartridge unit therein. Each flute of drums 601-603 may also contain at least one aperture for selectively applying vacuum force at the flute, i.e., to retain a cartridge unit in the flute and to accomplish drum-to-drum transfer of cartridge units. In aspects, the drums 601-603 are structured and arranged to provide drum-to-drum transfer of the cartridge units while maintaining the vertical orientation of the procession of cartridge units.

Still referring to FIGS. 22*a* and 22*b*, one or more detectors may be provided for detecting cartridge units that are out of specification after the mouth end insert insertion stage. For example, a first detector 610 may be configured to detect cartridge units in which a mouth end insert 8 is not properly inserted (e.g., canted), and a second detector 612 may be provided to detect cartridge units lacking a mouth end insert 8. The detectors 610, 612 may comprise cameras or other optical detecting mechanisms that detect optical characteristics of the cartridge units and communicates the detected optical characteristics to a controller "C". In turn, the controller "C" may be configured to determine whether a cartridge unit is out of specification by comparing the detected optical characteristics to predefined optical criteria. Any cartridge unit that is determined to be out of specification based on the detecting may be ejected from one of the rotating drums, e.g., by selectively overcoming the vacuum retention of a flute with a jet of air and/or by interrupting or disabling the vacuum at a rejection station 651 to eject the cartridge unit from the flute and into a reject chute.

With continued reference to FIGS. 22*a* and 22*b*, the system may include a fluted mitre drum 605 downstream of drum 603. In aspects, the mitre drum 605 is similar in construction to mitre drum 232 and functions to change the orientation of the cartridge units 70 from a vertical orientation to a horizontal orientation, so as to orient the procession of cartridge units for entry into the next workstation 700. In some embodiments, this change in orientation may not be necessary.

Figure 23:
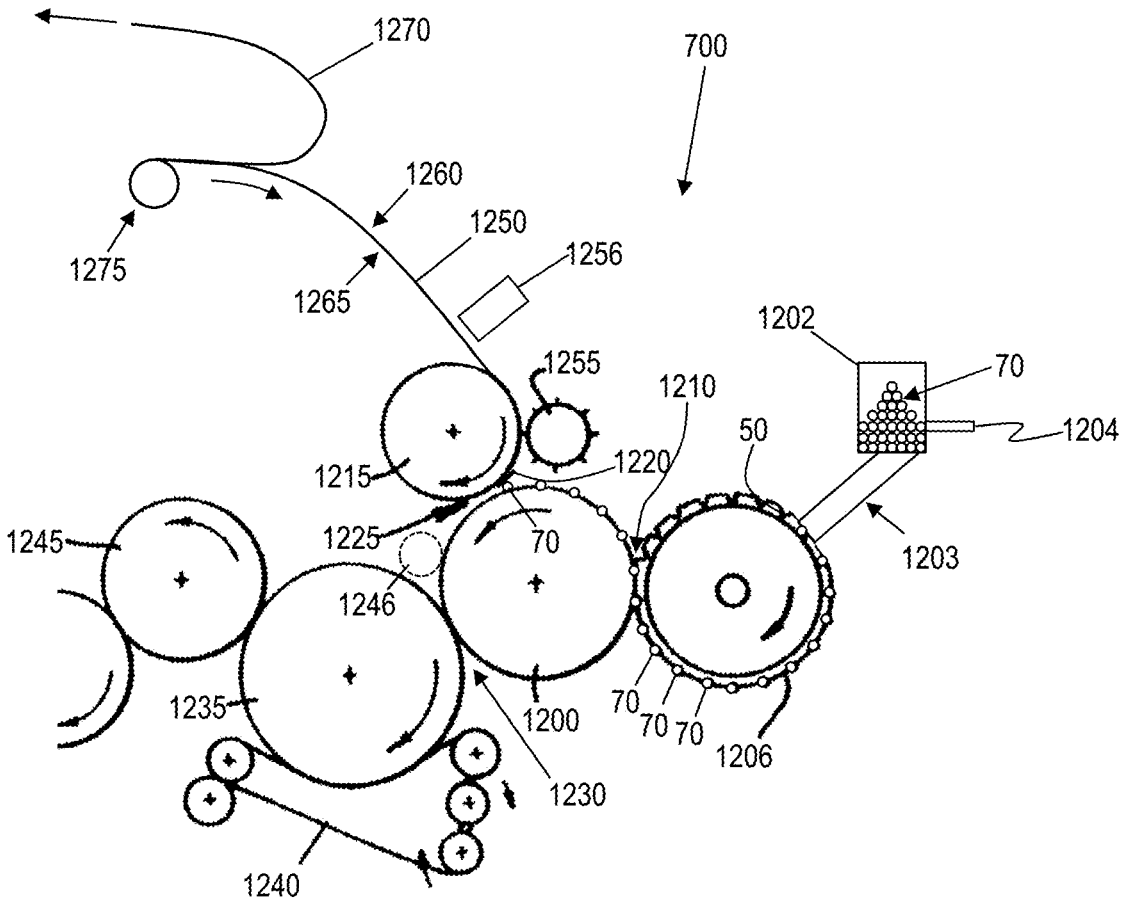

As shown in FIGS. 22*b* and 23, the system may include a labeler workstation 700 downstream of the mitre drum 605. Any desired arrangement of rotating drums 607-609 and/or conveyors 611 may be used to convey the cartridge units 70 in a horizontal orientation to the labeler workstation 700. The drums 607-609 operate using rotating drum transport principles as described with respect to FIGS. 9*a* and 9*b*. In example embodiments, the labeler stage 700 operates to automatically apply a label (e.g., wrapper) on an outer surface of the outer tube 6. The labeler workstation 700 may operate in a manner disclosed in U.S. application Ser. No. 14/686,519, filed concurrently herewith, and/or U.S. Pat. No. 5,024,242, the entire contents of each of which are incorporated herein by reference.

With reference to FIG. 23, the labeler workstation 700 includes an accumulator 1202 that receives cartridge units 70 from fluted conveyor 611 and holds a plurality of cartridge units 70. The accumulator 1202 functions as a buffer between the machinery that inserts the mouth end insert 8 and the machinery that applies a label to the outside of the casing 6. The accumulator 1202 may comprise, for example, a zig-zag or S-shaped pathway through which the horizontally oriented cartridge units 70 travel between an accumulator inlet and an accumulator outlet 1203. The accumulator inlet may be vertically higher than the accumulator outlet 1203 such that the cartridge units 70 move through the accumulator via gravity. The accumulator 1202 may be sized to receive cartridge units at the accumulator inlet at a faster rate than cartridge units are released at the accumulator outlet 1203. In this manner, the accumulator 1202 provides a buffer that compensates for empty slots in the procession along the conveyor 611, e.g., cartridge units that were ejected from the procession based on the inspection step or missing in the procession as a result of inconsistent loading.

A sensor 1204, such as a photo eye or similar, may be arranged at the accumulator 1202 to determine whether the number of cartridge units 70 in the accumulator 1202 exceeds a threshold. The sensor 1204 may be operatively connected to the controller "C". When the sensor 1204 communicates to the controller that the level of cartridge units 70 in the accumulator 1202 falls below the threshold, the controller may temporarily stop the drums downstream of the accumulator 1202, i.e., to pause the labeling operation. This pausing permits cartridge units 70 to accumulate in the accumulator 1202 since the upstream equipment may continue to process and deliver cartridge units 70 to the accumulator 1202. The sensor 1204 detects when a sufficient number of cartridge units 70 has accumulate in the accumulator 1202 (i.e., exceeds the threshold), at which time the controller, based on the signal from the sensor 1204, automatically re-starts the drums of labeler stage 700 to resume the labeling operation.

In example embodiments, a transfer drum 1206 with flutes 50 at spaced locations about its outer perimeter receives cartridge units 70 from the accumulator outlet 1203. For example, each flute 50 of the transfer drum 1206 is sized to receive a single cartridge unit 70. Each flute 50 may also have at least one aperture that is configured to selectively communicate a vacuum to a cartridge unit seated in the flute 50, i.e., so as to retain the cartridge unit 70 seated in the flute 50.

In example embodiments, the system is arranged such that rotation of the drum 1206 moves an empty flute 50 past and under the accumulator outlet 1203. Gravity pulls a cartridge unit 70 at the accumulator outlet 1203 into the empty flute 50. In addition to or alternatively to gravity, air pressure and/or a positive force applied by a wheel or belt may be used to move the cartridge unit 70 at the accumulator outlet 1203 into the empty flute 50. Vacuum may also be selectively applied to the flute 50 to assist in pulling the cartridge unit 70 from the accumulator outlet 1203 into the empty flute 50. As the drum 1206 rotates past the outlet 1203 of the accumulator 1202, the trailing wall of a flute 50 strips a cartridge unit 70 from the accumulator outlet 1203. At the same time, vacuum is communicated to the flute 50 to maintain the cartridge unit 70 in the flute 50 until rotation of the drum 1206 brings the cartridge unit to the nip at the next rotating drum 1200.

At location 1210, the cartridge units 70 are transferred from the transfer drum 1206 to a drum 1200, which rotates in a direction opposite the rotation of the drum 1206. Each cartridge unit 70 is held in a respective flute on the drum 1200. A tagging drum 1215 is situated adjacent drum 1200 and rotates in a direction opposite of drum 1200 (clockwise in FIG. 23). In example embodiments, the tagging drum 1215 carries a plurality of labels 1220 and tags a respective label 1220 to a respective cartridge unit 70 at location 1225.

At location 1230, each cartridge unit 70 with its associated label 1220 is transferred from the drum 1200 to a rolling drum 1235. The rolling drum 1235 moves each cartridge unit 70 and its associated, tagged label 1220 into contact with a moving endless belt 1240. The belt 1240 moves in a same direction as an adjacent portion of the surface of the rolling drum 1235 but at a slightly slower speed than the tangential speed at the flutes of the rolling drum 1235. The difference in speed between the belt 1240 and the rolling drum 1235 causes the cartridge unit 70 to rotate such that the tagged label 1220 wraps around the exterior surface of the cartridge unit 70. The labels may be provided with a pre-applied, pressure sensitive adhesive. After the labeling operation, the labeled cartridge units 70 are transferred from the rolling drum 1235 to a downstream transfer drum 1245 for transfer to another station for further processing, e.g., to a packaging workstation or a combiner workstation for connecting the cartridge unit 70 to a second section 72.

In example embodiments, an additional pressing roller 1246 may be provided adjacent to drum 1200 at a location after the label is tagged to the cartridge unit 70 and before the cartridge unit 70 is transferred to the rolling drum 1235. The pressing roller 1246 may be structured and arranged to press an unsecured leading edge of the label 1220 to the outer surface of the cartridge unit 70 prior to the cartridge unit 70 being passed to the rolling drum 1235.

Still referring to FIG. 23, in aspects described herein the label 1220 comprises an individual piece of paper or web that is cut from a continuous web 1250. For example, a rotating cutter 1255 or the like may cut the continuous web 1250 into discrete labels 1220 that are held to an operative surface of tagging drum 215 by application of a vacuum. A heater 1256, such as a hot air blower, heat plate, radiative element, etc., may be used to heat the web 1250 to increase the tackiness of the adhesive prior to tagging. In example embodiments, a first side 1260 of the continuous web 1250 has a pressure sensitive adhesive thereon, and a second side 1265 of the continuous web 1250 has no adhesive. The pressure sensitive adhesive is pre-applied to the continuous web 1250 and covered with a backing sheet 1270. For example, the continuous web 1250 may be provided by a spool 1275 with the adhesive and backing sheet 1270 already thereon.

Downstream of the labeler workstation 700, the now fully assembled cartridge units 70 may be sent to a packaging workstation or an assembly workstation, for example. In the packaging workstation, the fully assembled cartridge units 70 are packaged as replacement (e.g., refill) units to be sold to a consumer such that the consumer may connect one of the replacement units to an already owned battery section 72.

If directed to an assembly workstation, the fully assembled and labeled cartridge units 70 are transferred from an exit drum of the labeler workstation to an assembler workstation (e.g., via drum-to-drum transfer as previously described), and connected with a battery section 72 to complete a fully assembled electronic vaping device, such as that shown in FIGS. 1*a* and 1*b*. In example embodiments, a cartridge unit 70 may be automatically connected to a battery section 72 by transferring both elements in a flute of a rotating assembly drum, translating the cartridge unit 70 toward and the battery section 72 in the flute (or vice versa), and rotating the cartridge unit 70 or battery section 72 or both relative to each other in the flute such that the threaded connection is established between the elements. The translating the one of the elements in the flute may be performed using a swash plate, cam, or the like. The rotating one or both of the elements relative to the other element may be performed using a roll-bar, roll-hand, roll belts, or the like. Different connection processes may be employed for different types of connection structures of the cartridge unit 70 and the battery section 72. For example, when the cartridge unit 70 and the battery section 72 are connected with a bayonet connection, these sections may be connected by aligning the sections and axially moving one or both of the sections relative to one another to complete the bayonet connection.

In aspects, the battery section 72 is inspected prior to connecting the battery section 72 to the cartridge unit 70. For example, a vacuum may be applied to test the puff sensor. The inspection of the battery section may be performed in an automated manner under control of the controller "C". In example embodiments, this automated inspection is performed while the battery section 72 is carried by a fluted drum or fluted belt, such as those described herein.

In example embodiments, an electrical continuity test may be performed on wiring contained in the battery section 72 and/or the cartridge unit 70. For example, the electrical continuity of the heater coil 14 may be tested by touching test probes to the anode and connector and measuring electrical resistance. The electrical continuity test may be performed in an automated manner under control of the controller "C" while the section being tested (the battery section 72 and/or the cartridge unit 70) is carried by a rotating drum or fluted belt, such as those described herein.

In example embodiments, a resistance to draw (RTD) test may be performed on each cartridge unit 70. The RTD test is useful for determining whether the air inlets 44 of each cartridge unit 70 are providing a desired, predetermined level of RTD. The air inlets 44 are precision-formed within close tolerances and sized so as to be the predominating source of pressure drop along an air pathway of communication between the air inlets 44 and the source of vapor (the heater). Such arrangement and testing for RTD assures that RTD remains essentially the same from one electronic vaping device 60 to the next. Achieving consistent RTD from one electronic vaping device to the next promotes consistent performance and delivery levels, and enhances vaping experiences by meeting adult vaper's expectations.

In example embodiments, the air inlets 44 are sized and configured such that the electronic vaping device has a RTD in the range of from about 60 mm $H_2O$ to about 150 mm $H_2O$ (e.g., about 90 mm $H_2O$ to about 110 mm $H_2O$, about 100 mm $H_2O$ to about 130 mm $H_2O$), although any suitable range may be used. An RTD test as described herein may be performed to test whether each cartridge unit 70 provides the designed-for RTD. The RTD test may be performed in an automated manner under control of the controller "C" while the cartridge unit 70 is carried by a rotating fluted drum or fluted belt, such as those described herein.

In implementations, the RTD test includes blocking orifices other than the air inlets 44 (for example, sealing-off the central channel 34 in the anode post 47*c* of the cartridge unit 70); applying a predetermined amount of draw on the mouthpiece end portion of the cartridge unit 70; measuring a pressure drop that results when the draw is applied; and comparing the measured pressure drop to the predetermined target RTD. The above-described test for RTD is preceded by a cleaning stage, e.g., at a cleaning workstation, wherein orifices other than the air inlets 44 are blocked, and air is drawn through the cartridge unit 70 for a time sufficient to withdraw loose fibers and particles. The RTD test is useful in determining whether a cartridge unit 70 does, or does not, meet the target RTD for any reason, such as a blocked or damaged air inlet 44.

Figure 24A:
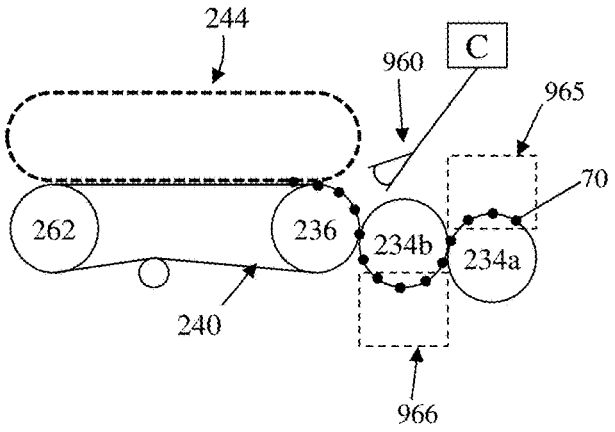
Figure 24B:
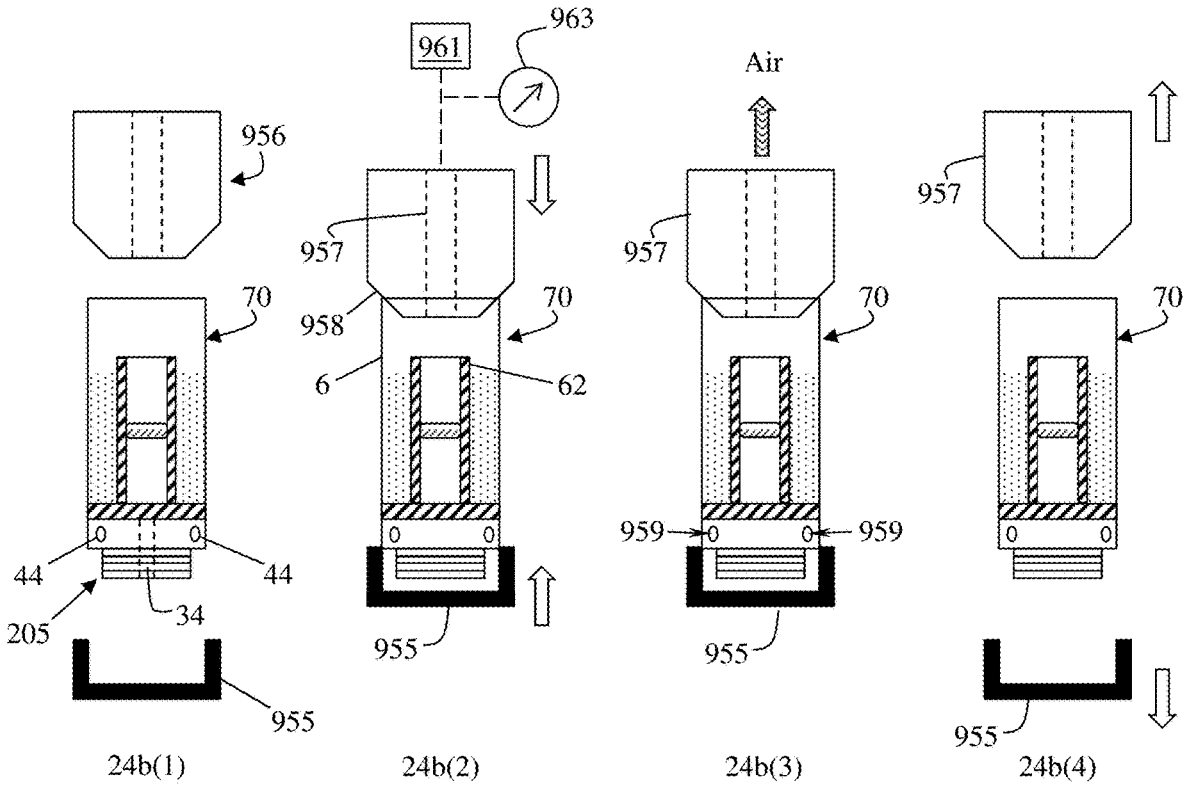

FIGS. 24*a* and 24*b* depict an implementation of an RTD test in accordance herewith. In example embodiments, the RTD test is performed on a cartridge unit 70 while the cartridge unit 70 is carried by a rotating fluted drum or fluted belt upstream of the filling workstation. For example, the RTD test may be performed on a cartridge unit 70 carried by drum 234 of FIG. 10*a* or another drum nearby. Alternatively, as shown in FIG. 24*a*, rotating fluted drums 234*a* and 234*b* may be added to the system upstream of drum 236. Drums 234*a-b* may be similar to the drums generally described in FIG. 9*a* and may be configured for carrying the cartridge units 70 of the procession during RTD testing. In particular, drum 234*a* may receive a cartridge unit 70 from drum 234 using drum to drum transfer techniques described herein. While the cartridge unit 70 is on drum 234*a*, cleaning air may be drawn through the cartridge unit 70 to remove any loose fibers, particles, etc., that may affect airflow through the cartridge unit 70. For example, an air pressure or suction source may be temporarily moved into contact with the open mouthpiece end of the cartridge unit 70 to provide the cleaning air while the cartridge unit 70 is held in a flute of the rotating drum 234*a*. After the cleaning air step, the cartridge unit 70 is transferred from drum 234*a* to drum 234*b* using drum to drum transfer techniques described herein.

FIG. 24*b* shows steps of a RTD test that may be performed, for example, while the cartridge unit 70 is on drum 234*b*. In example embodiments, while the cartridge unit 70 is held in a flute on rotating drum 234*b* as depicted at 24*b*(1), an occluder 955 is moved into contact with the threaded connection 205 end of the cartridge unit 70 and a fixture 956 is also moved into contact with the open mouthpiece end of the cartridge unit 70 as depicted at 24*b*(2). In example embodiments, the occluder 955 is structured and arranged to block air flow paths of cartridge unit 70 the other than air inlets 44. For example, the occluder 955 may be a structure that encloses a portion of the threaded section 205, to block air flow through a central passage 34 of the anode post 47*c* (see FIGS. 2 and 3). The passage 34 provides a flow path to the puff sensor during normal operation when the electronic vaping device is fully assembled. As another example, the occluder 955 may be a pin or a resilient plug that is inserted into the central passage 34.

In example embodiments, the fixture 956 is moveable to and from a retracted position and an extended position. In the extended position, a tapered end portion 958 of the fixture 956 seals against the upper rim of the outer casing 6 but does not come into contact with the chimney 62. A passage 957 in the fixture 956 communicates with an air pump 961 and a pressure gauge 963. The pump 961 withdraws air from the passage 957 at a prescribed volumetric rate and the pressure drop is measured by the gauge 963. The arrangement of the occluder 955 and the fixture 956 shown in FIG. 24*b* is merely an example, and other arrangements may be used. The order of bringing the occluder 955 and the fixture 956 into contact with the cartridge unit 70 is not critical; either one may be brought into contact with the cartridge unit 70 before the other, or both may be brought into contact with the cartridge unit 70 at the same time.

When the occluder 955 and the conduit 957 are both contacting the cartridge unit 70, the pump 961 draws air through the passage 957 of the fixture 956 as depicted at 24*b*(3). This draw pulls air through the air inlets 44 as depicted by arrows 959, and the magnitude of RTD (e.g., pressure drop) is measured while in this configuration using the pressure gauge 963 or other appropriate sensor. After performing the measurement, the occluder 955 and the conduit 957 are retracted out of contact with the cartridge unit 70 as depicted at 24*b*(4). In example embodiments, the controller "C" compares the measured magnitude of RTD of the cartridge unit 70 to predefined acceptable levels of RTD, such as an acceptable range defined between a low RTD threshold and a high RTD threshold. A cartridge unit 70 that is determined to have an acceptable measured RTD based on this test remains in the procession and proceeds to the filling workstation. A cartridge unit 70 that is determined to have an unacceptable measured RTD based on this test is ejected from the procession, e.g., blown off drum 234*b* after the occluder 955 and the conduit 957 are moved out of contact with the cartridge unit 70. A sensor 960 may be arranged downstream of drum 234*b* and before the belt 244 to detect missing cartridge units 70 after the RTD test, i.e., to account for cartridge units 70 that may have been ejected due to a failed RTD test. The particulars of the RTD test described herein are merely examples, and other processes may be used to perform an RTD test on each cartridge unit 70 of the procession.

As shown in FIG. 24*a*, the cleaning stage is executed while the cartridge units 70 are carried on a rotating fluted drum 234*a* at a cleaning workstation 965, and the RTD test is executed while the cartridge units are carried on a rotating fluted drum 234*b* at an RTD test workstation 966 upstream of the filling workstation. Execution of cleaning may be performed with an apparatus in a manner similar to that shown and described for RTD testing in reference to FIG. 24*b*. Although the cleaning operation and the RTD tests are shown as conducted along drum(s) of separate workstations, it should be understood that both operations could be performed on a single drum and/or with a single set of fixtures 955 and 956.

FIG. 25 shows a flow diagram 800 of a process in accordance with aspects described herein. Steps 801-831 of flow diagram 800 may be performed using systems and methods described herein.

After the cartridge units have been oriented in a desired direction (e.g., step 802), the procession of oriented cartridge units may be passed through an inline vacuuming arrangement prior to proceeding to the filling station (e.g., step 805). The inline vacuuming arrangement may be a series of opposing orifices, wherein orifices on one side supply compressed air while orifices on the other side draw a vacuum. The procession of cartridge units may be positioned such that the longitudinal ends are simultaneously subjected to the compressed air and vacuum from a corresponding pair of opposing orifices when passing through the inline vacuuming arrangement. Because a plurality of pairs of opposing orifices may be serially arranged, each of the cartridge units may have multiple exposures to the simultaneous compressed air and vacuum prior to exiting the inline vacuuming arrangement. The air flow of the inline vacuuming arrangement may be coaxial (or transverse) to the cartridge units.

In other embodiments, the cartridge units may be filled while moving on a rotating fluted drum, rather than on a fluted belt. For example, the filling workstation may include at least one filling drum comprising a rotating fluted drum that carries the cartridge units while the cartridge units are filled in a manner similar to the filling described herein. In such an embodiment, the carriage 246 may be structured and arranged to move in reciprocating manner along an arcuate to facilitate moving the needles 250 into the cartridge units that are carried on the rotating filling drum.

In still further embodiments, the procession of oriented cartridge units may be spilt into plural processions of oriented cartridge units that undergo processing in parallel. For example, the procession of oriented cartridge units may be split into a first procession that is processed at a first filling workstation and a second procession that is processed at a second filling workstation, in which the processing at the first and second filling workstations occurs in parallel (e.g., simultaneously). The first procession and the second procession may be re-combined to a single procession downstream of the filling workstations.

In aspects described herein, the downstream gasket 10 constitutes a sealing element and the mouthpiece insert 8 is separate from the downstream gasket 10. In other embodiments, each cartridge unit may be provided with a single element that both seals that liquid reservoir and provides a mouthpiece surface. This single element may be used instead of the two separate elements described herein, i.e., the downstream gasket and the mouth end insert. In such an embodiment, the assembly path may be modified by replacing the two workstations that execute steps 400 and 500 with a single workstation that inserts the single element into the cartridge unit. The drum-to-drum transport paths between workstations of the assembly path may be modified (e.g., drums added, subtracted, moved, etc.) to accommodate different numbers and/or locations of workstations.

In additional embodiments, the cartridge units may be partially assembled and established in the procession at an earlier portion of the assembly path, rather than receiving the partially assembled cartridge units from another facility. For example, one or more workstations may be added upstream of the filling workstation, wherein the cartridge units are partially assembled at the one or more workstations using automated processes. An output of the one or more workstations may be connected to the conveyor 220 or a drum-to-drum transport path that delivers the procession of oriented, partially assembled cartridge units to the accumulator 225.

The particulars shown herein are by way of example and for purposes of illustrative discussion only and are presented in the cause of providing what is believed to be the most useful and readily understood description of the principles and conceptual aspects. In this regard, no attempt is made to show structural details in more detail than is necessary for fundamental understanding, the description taken with the drawings making apparent to those skilled in the art how the several forms disclosed herein may be embodied in practice.

It is noted that the foregoing examples have been provided merely for the purpose of explanation and are in no way to be construed as limiting. While aspects have been described with reference to example embodiments, it is understood that the words which have been used herein are words of description and illustration, rather than words of limitation. Changes may be made, within the purview of the appended claims, as presently stated and as amended, without departing from the scope and spirit of the present disclosure in its aspects. Although aspects have been described herein with reference to particular means, materials, and/or embodiments, the present disclosure is not intended to be limited to the particulars disclosed herein; rather, it extends to all functionally equivalent structures, methods and uses, such as are within the scope of the appended claims.

The invention claimed is:

1. A method for automated manufacturing of e-vapor devices, comprising:

organizing a feed of cartridge units of the e-vapor devices into a procession of cartridge units moving along an assembly path;

supplying the cartridge units with a liquid while the cartridge units are moving on a first fluted transport section of the assembly path, wherein the supplying includes inserting a needle into each of the cartridge units, the needle being positioned adjacent to a periphery thereof prior to injecting the liquid, the needle configured to move downward to a first filling position while adjacent to the periphery and configured to move upward to a second filling position while adjacent to the periphery;

sealing the cartridge units with the liquid therein while the cartridge units are moving on a second fluted transport section of the assembly path; and inspecting the cartridge units before or after at least one of the organizing, supplying, and sealing and, based on results of the inspecting, ejecting non-compliant units from the procession of the cartridge units moving along the assembly path.

2. The method of claim 1, wherein the organizing includes orienting an open end of each of the cartridge units in a same upward direction.

3. The method of claim 1, wherein the organizing includes using a vacuum to maintain a position of each of the cartridge units within a fluted surface of at least one of the first fluted transport section and the second fluted transport section of the assembly path.

4. The method of claim 1, wherein the sealing includes inserting a gasket into each of the cartridge units so as to be positioned above the liquid therein.

5. The method of claim 4, wherein the sealing further includes inserting a mouthpiece into each of the cartridge units.

6. The method of claim 1, wherein the inspecting includes optically detecting the cartridge units for at least one of damage, misorientation, spillage, leakage, and misassembly.

7. The method of claim 1, wherein the inspecting includes testing a resistance to draw (RTD) of each of the cartridge units.

8. The method of claim 1, wherein the inspecting includes performing an electrical continuity test on each of the cartridge units.

9. The method of claim 1, wherein the ejecting is performed with a jet of air through a fluted surface of the assembly path.

10. A system for automated manufacturing of e-vapor devices, comprising:

a feed source of cartridge units of the e-vapor devices;

an assembly path in communication with the feed source, the assembly path defined by at least a plurality of fluted surfaces, the plurality of fluted surfaces configured to receive the cartridge units and to engage in an endless motion so as to produce a procession of the cartridge units along the assembly path;

a filling station arranged downstream from the feed source on the assembly path, the filling station configured to supply the procession of the cartridge units with a liquid while the cartridge units are moving on a first fluted transport section of the assembly path, wherein the supply of the liquid includes inserting a needle into each of the cartridge units, the needle being positioned adjacent to a periphery thereof prior to injecting the liquid, the needle configured to move downward to a first filling position while adjacent to the periphery and configured to move upward to a second filling position while adjacent to the periphery;

a sealing station arranged downstream from the filling station on the assembly path, the sealing station configured to insert a sealing element into each of the cartridge units to seal the liquid therein while the cartridge units are moving on a second fluted transport section of the assembly path; and an inspection station arranged downstream from the feed source on the assembly path, the inspection station configured to detect and eject non-compliant units from the procession of the cartridge units moving along the assembly path.

11. The system of claim 10, wherein the feed source is configured to orient the cartridge units in a same direction.

12. The system of claim 10, wherein the assembly path includes a plurality of drums including the plurality of fluted surfaces, the plurality of drums arranged to perform a drum-to-drum transfer of the cartridge units to advance the procession.

13. The system of claim 10, wherein each of the plurality of fluted surfaces is in a form of a groove having a shape configured to correspond to an outer surface of a corresponding one of the cartridge units.

14. The system of claim 10, wherein each of the plurality of fluted surfaces includes a port opening extending therethrough, the port opening configured to draw a vacuum to hold a corresponding one of the cartridge units against a receiving one of the plurality of fluted surfaces.

15. The system of claim 10, wherein the plurality of fluted surfaces are covered with a resilient material, the resilient material being more yielding than a constituent material of the plurality of fluted surfaces.

16. The system of claim 10, wherein the plurality of fluted surfaces defining at least one of the first fluted transport section and the second fluted transport section of the assembly path are arranged in parallel.

17. The system of claim 10, wherein the sealing station is configured to insert at least one of a gasket and a mouthpiece as the sealing element.

18. The system of claim 10, wherein the inspection station is configured to eject the non-compliant units with a jet of air through a corresponding one or more of the plurality of fluted surfaces of the assembly path.

19. The system of claim 10, further comprising:

an accumulator configured to accrue the cartridge units as a buffer that compensates for at least one of empty slots in the procession and different operating speeds of the filling station and the sealing station.

20. The method of claim 1, wherein the supplying further includes moving the needle downward into each of the cartridge units after being positioned adjacent to a periphery thereof.

21. The method of claim 1, wherein the organizing includes a negative application of air to the cartridge units, and the inspecting includes a positive application of air to the non-compliant units.

* * * * *